US012049825B2

(12) United States Patent
Russell

(10) Patent No.: US 12,049,825 B2
(45) Date of Patent: Jul. 30, 2024

(54) PROJECTILE AUGMENTED BORING SYSTEM

(71) Applicant: HYPERSCIENCES, INC., Spokane, WA (US)

(72) Inventor: Mark C. Russell, Spokane, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 0 days.

(21) Appl. No.: 17/096,435

(22) Filed: Nov. 12, 2020

(65) Prior Publication Data

US 2021/0148229 A1 May 20, 2021

Related U.S. Application Data

(60) Provisional application No. 62/978,166, filed on Feb. 18, 2020, provisional application No. 62/936,280, filed on Nov. 15, 2019.

(51) Int. Cl.
*E21C 37/00* (2006.01)
*E21D 9/10* (2006.01)
(Continued)

(52) U.S. Cl.
CPC ..... *E21C 37/005* (2013.01); *E21D 9/1053* (2013.01); *E21D 9/128* (2013.01);
(Continued)

(58) Field of Classification Search
CPC ..... E21C 37/005; E21D 9/006; E21D 9/106; E21D 9/112; E21D 9/003; E21D 9/108;
(Continued)

(56) References Cited

U.S. PATENT DOCUMENTS 1,241,386 A 9/1917 Hutton
1,585,664 A * 5/1926 Gilman ..... E21C 37/00 299/13
(Continued)

FOREIGN PATENT DOCUMENTS

CA 2107536 A1 * 4/1994 ..... E21C 37/005
CN 101017076 A 8/2007
(Continued)

OTHER PUBLICATIONS

English language machine translation of Bohnes et al., German Patent Publication No. DE-2813143-A, published Sep. 27, 1979 (7 pages) (Year: 1979).*
(Continued)

*Primary Examiner* — Nicole Coy
*Assistant Examiner* — Michael A Goodwin
(74) *Attorney, Agent, or Firm* — Lindauer Law, PLLC

(57) ABSTRACT

Systems for forming or extending a tunnel or shaft within a working surface may include a ram accelerator assembly for accelerating a projectile into geologic material to weaken a region of the geologic material. A cutting tool may then be used to remove the weakened material. A collection assembly may be used to move debris away from the working surface while the projectile and cutting operations are performed to enable generally continuous use of the system. The number of projectiles that are accelerated and the rate at which projectiles are used may be controlled based on characteristics of the geologic material and the rate at which created debris may be removed.

20 Claims, 15 Drawing Sheets

(51) Int. Cl.
*E21D 9/12* (2006.01)
*E21D 9/00* (2006.01)
*E21D 9/11* (2006.01)

(52) U.S. Cl.
CPC ..... *E21D 9/003* (2013.01); *E21D 9/006* (2013.01); *E21D 9/108* (2013.01); *E21D 9/112* (2013.01)

(58) Field of Classification Search
CPC ..... E21D 9/128; E21D 9/1053; E21D 9/1066; E21B 7/007; E21B 49/04
See application file for complete search history.

(56) References Cited

U.S. PATENT DOCUMENTS 2,544,573 A * 3/1951 Renic ..... E21B 7/007 175/328
2,621,732 A 12/1952 Ahlgren
2,913,959 A 11/1959 Mohaupt
3,075,463 A 1/1963 Eilers et al.
3,185,224 A 5/1965 Robinson
3,190,372 A 6/1965 Johnson
3,244,232 A 4/1966 Myers
3,253,511 A 5/1966 Zwicky
3,434,380 A 3/1969 Dardick
3,441,095 A 4/1969 Youmans
3,623,771 A 11/1971 Sosnowicz et al.
3,633,686 A 1/1972 Bennett
3,695,715 A * 10/1972 Godfrey ..... E21C 37/00 299/13
3,855,931 A 12/1974 Dardick
3,863,723 A 2/1975 Godfrey
3,867,867 A 2/1975 Duff
3,922,015 A * 11/1975 Poundstone ..... E21C 41/18 299/1.1
3,963,275 A * 6/1976 Godfrey ..... E21C 37/005 299/13
4,004,642 A * 1/1977 Dardick ..... E21B 4/00 175/4.5
4,030,557 A * 6/1977 Alvis ..... E21B 7/007 175/4.5
4,063,486 A 12/1977 Ashley
4,123,975 A 11/1978 Mohaupt
4,158,388 A 6/1979 Owen et al.
4,467,878 A 8/1984 Ibsen
4,582,147 A 4/1986 Dardick
4,638,712 A 1/1987 Chawla et al.
4,679,637 A 7/1987 Cherrington et al.
4,722,261 A 2/1988 Titus
4,791,850 A 12/1988 Minovitch
4,907,488 A 3/1990 Seberger
4,932,306 A 6/1990 Rom
4,982,647 A 1/1991 Hertzberg et al.
5,063,826 A 11/1991 Bulman
5,097,743 A 3/1992 Hertzberg et al.
5,098,163 A 3/1992 Young
5,146,992 A 9/1992 Baugh
5,233,903 A 8/1993 Saphier et al.
5,421,237 A 6/1995 Naumann
5,487,405 A 1/1996 Skoglund
5,574,244 A 11/1996 Powell et al.
5,578,783 A 11/1996 Brandeis
5,768,940 A 6/1998 Kawaguchi et al.
5,833,003 A 11/1998 Longbottom et al.
5,996,709 A 12/1999 Norris
6,000,479 A 12/1999 Ambs
6,035,784 A 3/2000 Watson
6,457,417 B1 10/2002 Beal
6,467,387 B1 10/2002 Espinosa
6,591,731 B2 7/2003 Goldstein
6,820,697 B1 11/2004 Churchill
7,069,862 B2 7/2006 Bassett
7,681,352 B2 3/2010 Fu et al.
7,775,148 B1 8/2010 McDermott
7,942,481 B2 5/2011 Leppänen
8,104,568 B2 1/2012 Luchini et al.
8,181,561 B2 5/2012 Riggs et al.
8,302,584 B1 11/2012 Lu
8,538,697 B2 9/2013 Russell et al.
8,943,970 B2 2/2015 Greeley
9,103,618 B2 8/2015 Daniel et al.
9,103,624 B1 8/2015 Kung et al.
9,169,695 B1 10/2015 Calvert
9,500,419 B2 11/2016 Russell
9,540,895 B2 1/2017 MacKenzie et al.
9,988,844 B2 6/2018 Russell et al.
10,132,578 B2 11/2018 Knowlen et al.
10,329,842 B2 6/2019 Russell
10,557,308 B2 2/2020 Russell
10,590,707 B2 3/2020 Russell et al.
10,697,242 B2 6/2020 Russell et al.
11,624,235 B2 4/2023 Russell et al.
2001/0045288 A1 11/2001 Allamon et al.
2002/0100361 A1 8/2002 Russell
2005/0034896 A1 2/2005 Youan
2007/0044963 A1 3/2007 MacDougall
2007/0186761 A1 8/2007 Perry
2007/0256826 A1 11/2007 Ceccarelli et al.
2008/0205191 A1 8/2008 Coste et al.
2009/0322185 A1 12/2009 Barnard et al.
2010/0032206 A1 2/2010 Becker et al.
2010/0133006 A1 6/2010 Shakra et al.
2011/0114388 A1 5/2011 Lee et al.
2011/0186377 A1 8/2011 Kline
2013/0032337 A1 2/2013 Rytlewski et al.
2013/0200680 A1* 8/2013 Cho ..... E21D 9/1053 299/1.4
2014/0158356 A1 6/2014 Andrzejak et al.
2014/0260930 A1 9/2014 Russell
2014/0367604 A1 12/2014 Alexander
2015/0021023 A1 1/2015 Roberts et al.
2015/0152700 A1 6/2015 Lovorn et al.
2015/0330147 A1 11/2015 Russell
2016/0356087 A1* 12/2016 Russell ..... E21B 49/04
2016/0362936 A1 12/2016 Russell
2017/0130531 A1* 5/2017 Russell ..... F41A 1/04
2017/0138128 A1 5/2017 Russell
2017/0298730 A1* 10/2017 Brandl ..... C01B 33/035
2017/0307313 A1* 10/2017 Knowlen ..... F41A 1/02
2018/0073301 A1* 3/2018 Russell ..... E21B 47/00
2018/0202288 A1 7/2018 Elbadawy et al.

FOREIGN PATENT DOCUMENTS

CN 101099024 A 1/2008
CN 102322216 A 1/2012
CN 102822442 A 12/2012
CN 202596572 U 12/2012
CN 103321572 A 9/2013
CN 102667047 B 11/2015
DE 2420035 A1 3/1976
DE 2813143 A * 9/1979 ..... E21D 11/403
DE 3742439 A1 * 6/1989
EP 0663582 A3 11/1995
EP 1764577 A1 3/2007
GB 1371297 A 10/1974
KR 20120034545 A 4/2012
WO 1999037878 A1 7/1999
WO 2014149173 A1 9/2014
WO 2015030730 A1 3/2015

OTHER PUBLICATIONS

Kermani, Nathalie, "PCT Notification of Transmittal of the International Search Report and Written Opinion dated Feb. 17, 2021", Patent Cooperation Treaty Application No. PCT/US20/60451, Patent Cooperation Treaty, Feb. 17, 2021.

"Drilling and Excavation Technologies for the Future Technologies", Committee on Advanced Drilling, National Research Council, ISBN: 0-309-57320-3. Retrieved from http://www.nap.edu/catalog/2349.html.

(56) References Cited

OTHER PUBLICATIONS

Bogdanoff, David W., "New Tube End Closure System for the Ram Accelerator", Journal of Propulsion and Power., vol. 10, No. 4, Jul. 1-Aug. 1994, pp. 518-521.
Fang, et al., "Hypersonic Wave Drag Reduction Performance of Cylinders With Repetitive Laser Energy Depositions", 3rd Int'l Photonics & OptoElectronics Meetings (POEM 2010), Journal of Physics: Conference Series 276 (2011) 012021, IOP Publishing [retrieved on Oct. 20, 2015]. Retrieved from http://iopscience.iop.org/article/10.1088/1742-6596/276/1/012021. 8 pages.
Gold, et al., "Concrete Penetration by Eroding Projectiles Experiments and Analysis", Journal of Engineering Mechanics, v122, Feb. 1996, pp. 145-152 [Retrieved from: ascelibrary.org on Feb. 17, 2013.].
Gold, et al., "Constitutive Models for Concrete Penetration Analysis", Journal of Engineering Mechanics, vol. 122, Mar. 1996, pp. 230-238. Retrieved from ascelibrary.org on Feb. 17, 2013.
Hansen, Viggo, "Ram Accelerator Animation", Published on May 2, 2011.
Lundquist, Robert G., "Underground Tests of the Ream Method of Rock Fragmentation for High-Speed Tunneling", Rapid Excavation and Tunneling Conference Proceedings, Ch 56, Retrieved from: http://www.onemine.org/view/?d=689528D8459E7257609C73381053FBF203FD5CC5A9FC7839952A414670F0591638551, Mar. 13, 2013, Jan. 1974, pp. 825-840.
Nakamura, Yukari, "International Preliminary Report on Patentability dated May 17, 2022", Patent Cooperation Treaty Application No. PCT/US20/60451, Patent Cooperation Treaty, May 17, 2022.
Goodwin, Michael Alan, "Final Office Action dated Aug. 24, 2023", U.S. Appl. No. 17/457,007, The United States Patent and Trademark Office, Aug. 24, 2023.
Ro, Yong-Suk, "Non-final Office Action dated Sep. 14, 2023", U.S. Appl. No. 18/172,728, The United States Patent and Trademark Office, Sep. 14, 2023.

* cited by examiner

PROJECTILE AUGMENTED BORING SYSTEM

PRIORITY

The current application claims priority to U.S. provisional application 62/936,280, filed Nov. 15, 2019. The current application also claims priority to U.S. Provisional Application 62/978,166, filed Feb. 18, 2020. Application 62/936,280 and Application 62/978,166 are both incorporated by reference herein in their entirety.

INCORPORATION BY REFERENCE

The following United States patents and patent applications are incorporated by reference for all that they contain:

- U.S. patent application Ser. No. 13/841,236, filed on Mar. 15, 2013, entitled "Ram Accelerator System", now issued as U.S. Pat. No. 9,500,419.
- U.S. patent application Ser. No. 14/708,932, filed on May 11, 2015, entitled "Ram Accelerator System with Endcap", now issued as U.S. Pat. No. 9,458,670.
- U.S. patent application Ser. No. 14/919,657, filed on Oct. 21, 2015, entitled "Ram Accelerator System with Rail Tube", now issued as U.S. Pat. No. 9,988,844.
- U.S. patent application Ser. No. 15/135,452, filed on Apr. 21, 2016, entitled "Ram Accelerator System with Baffles", now issued as U.S. Pat. No. 10,697,242.
- U.S. patent application Ser. No. 15/340,753, filed on Nov. 1, 2016, entitled "Projectile Drilling System", now issued as U.S. Pat. No. 10,557,308.
- U.S. patent application Ser. No. 15/698,549, filed on Sep. 7, 2017, entitled "Augmented Drilling System", now issued as U.S. Pat. No. 10,590,707
- U.S. patent application Ser. No. 15/348,796, filed on Nov. 10, 2016, entitled "System for Generating a Hole Using Projectiles", now issued as U.S. Pat. No. 10,329,842.
- U.S. patent application Ser. No. 15/871,824, filed on Jan. 15, 2018, entitled "System for Acoustic Navigation of Boreholes".

BACKGROUND

Traditional drilling and excavation methods utilize drills to form holes in one or more layers of material to be penetrated. For example, conventional mining techniques to form a tunnel or shaft in rock or a similar material may include combinations of drilling and blasting operations (e.g., use of explosives). These operations may produce broken rock and other debris, and hauling operations may be used to transport the broken rock and other debris away from a workface. These processes may account for over 55% of the time utilized in a mining operation, which may slow the advancement of a mining shaft or tunnel. For example, using conventional mining techniques, a tunnel may only be advanced by a distance of 10-20 feet per round (e.g., one cycle of tunneling or blasting followed by one cycle of debris removal), which may result in an advancement of a shaft or tunnel by a distance of less than 100 feet per day.

BRIEF DESCRIPTION OF FIGURES

The detailed description is set forth with reference to the accompanying figures.

Figure 1:
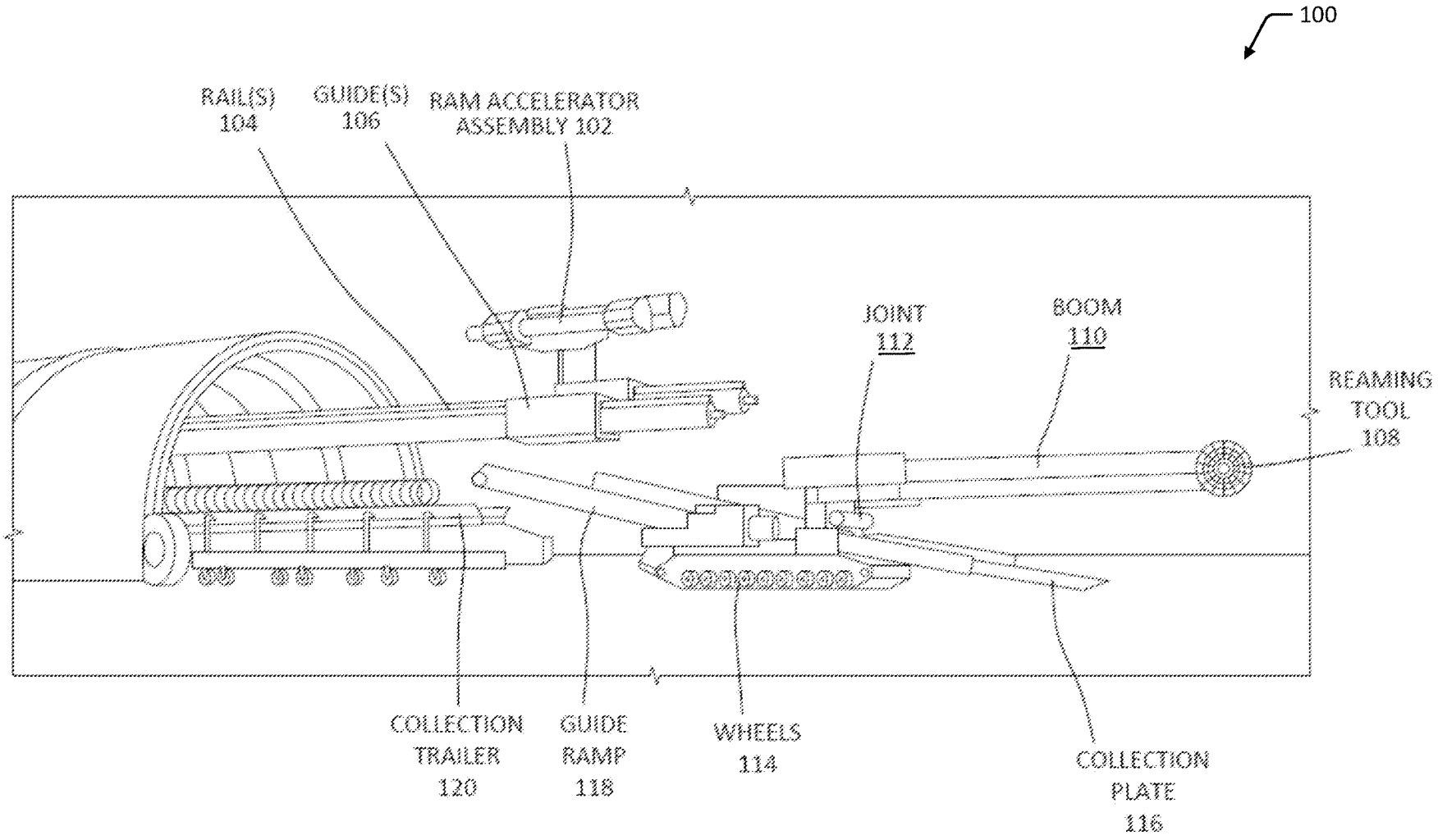
FIG. 1 depicts an implementation of a system that may be used for generally continuous tunneling, boring, or mining operations.

While implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

Described in this disclosure are techniques that may enable generally continuous mining, tunneling, and boring operations, which may improve efficiency over conventional techniques. To weaken the rock or other material located at a workface, such as the end of a shaft or tunnel to be extended, projectiles may be accelerated into the workface. In some implementations, a ram accelerator assembly may use pressurized gas to accelerate the projectiles using a ram effect caused by interaction between exterior features of the projectile and interior features of a tube or other conduit of the ram accelerator assembly. In some implementations, a projectile may be accelerated using combustion of materials, such as low-cost chemical energy generated by the combustion of diesel or natural gas. Additionally, in some implementations, projectiles may be formed from low-cost materials, such as concrete. In some implementations, the materials, the geometry, or both the materials and the geometry of the projectiles may be customized to control the depth by which a tunnel is extended or to affect the shape of the tunnel. For example, a pointed or wedge-shaped projectile may penetrate more deeply and easily into certain types of materials. Additionally, the types and quantities of accelerants used to apply a force to the projectiles may also be modified to customize the characteristics of the impact with the rock face. For example, accelerating a projectile to a ram velocity using a pressurized gas may affect the manner in which the projectile interacts with the workface and the shape of a crater that is formed, when compared to an impact by a projectile having a lower velocity.

The impact of an accelerated projectile with a rock face or other type of workface may displace or weaken the material of the workface, which may facilitate extending a tunnel or shaft through the material more rapidly and more safely. After impacting a workface with one or more projectiles, a boring or reaming tool may be brought into contact with the workface. The boring or reaming tool may more easily and quickly penetrate through the weakened material, with less wear on the cutting surfaces of the tool. Additionally, in some implementations, the disclosed mining, tunneling, and boring operations may be performed while decreasing or eliminating conventional use of explosives in on-site operations, which may decrease cost and increase safety associated with the operations. For example, use of projectile impacts to weaken a workface may cause the use of explosives to be unnecessary in some cases. In some cases, extending a tunnel using accelerated projectiles may be performed from 3 to 10 times more rapidly than conventional methods, at up to 35% lower cost. For example, use of accelerated projectiles to impact a workface may enable faster boring than conventional methods since the power provided by the impact of the projectiles is equal to $0.5*D*V^2$, where D is the density of the projectile and V is the velocity of the projectile. For example, use of accelerated projectiles traveling at a speed of 1500-2000 meters per second may have a dynamic pressure that is 10 to 100 times the strength of the rock or other material impacted by the projectiles. Factors that affect the interaction between a projectile and a workface may include projectile velocity, projectile mass, and the ration of the density of the projectile to that of the workface.

In some implementations, the described operations may be performed more continuously than conventional techniques by performing operations to remove debris at least partially simultaneously with boring operations. For example, a ramp, conveyor system, or other device for collecting debris formed by projectile impacts and boring operations may remove debris to a trailer or other movable receptacle for collecting debris or other material. Continuing the example, a reaming or boring tool may be attached to a vehicle, rails, or other means of providing motion to the tool. A collection plate, ramp, conveyor system, or similar mechanism may be positioned on the same vehicle or assembly, such that debris created by the boring or tunneling operations may be collected and removed while the boring or tunneling operations are performed. In some implementations, one or a series of vehicles or other types of assemblies that are configured to be moved into and out from a tunnel that is being formed may be used to perform the operations described herein. For example, a ram accelerator assembly may move along rails, tracks, wheels, and so forth to be placed in a position to accelerate one or more projectiles into a workface. A boring tool may be positioned on a wheeled or tracked vehicle, or other type of movable assembly, to be brought into contact with the workface after one or more projectile impacts. A collection assembly for collecting and removing debris from the workface may be associated with the same vehicle or assembly as the boring tool, or a separate vehicle or assembly, and may be moved into a position to remove debris created by a boring or tunneling operation. In some implementations, the disclosed mining, tunneling, and boring operations may be performed remotely, such as through use of autonomous equipment or equipment that may be controlled remotely. For example, one or more computing devices located in a location remote from that of the equipment may be used to communicate with controllers associated with ram accelerator assemblies, boring assemblies, collection assemblies, and so forth to control the use of projectiles, boring tools, and the collection of debris.

Implementations described herein may be used in drilling, mining, tunneling, and boring operations, as well as open pit drilling, open pit bench mining, continuous underground and tunneling operations, continuous rock removal and categorization operations, and other types of operations. Use of low-cost industrial gasses as propellant material to accelerate projectiles, and low-cost material to form projectiles may enable efficient extension of tunnels and shafts at a lower cost than conventional techniques. Additionally, faster rates for advancing a tunnel or shaft at a lower cost may be achieved by increasing the velocity and mass of projectiles. The firing parameters for a ram accelerator assembly may be selected to optimize for stability, speed, cost, or other factors.

FIG. 1 depicts an implementation of a system 100 that may be used for generally continuous tunneling, boring, or mining operations. The system 100 may include a plurality of vehicles or other types of assemblies that may be moved relative to a workface, such as the end of a tunnel or shaft. In some implementations, each assembly may be moved separately from other assemblies. Additionally, in some implementations, each assembly and the operation thereof may be controlled remotely, such as through use of one or more computing devices located remote from a site where a tunneling, boring, or mining operation is performed. Computing devices may communicate with controllers that are associated with various components of the system 100, such as to cause acceleration of projectiles into a workface, actuation of a cutting tool, collection of debris, and so forth.

A first assembly of the system 100 may include a ram accelerator assembly 102. The ram accelerator assembly 102 may be used to accelerate projectiles into a workface, such as the end of a tunnel or shaft to be extended. The ram accelerator assembly 102 may include one or more chambers for containing projectiles and propellant materials. For example, a first chamber may include a combustible material, such as diesel fuel, natural gas, or other types of material that may be ignited to apply a force to a projectile within a second chamber. In other implementations, the propellant material may include one or more gas generating materials. In still other implementations, the propellant material may include one or more explosive materials. In some implementations, a system may include equipment for performing high pressure electrolysis to create hydrogen and oxygen for use accelerating projectiles, reducing or eliminating the need to supply a ram accelerator assembly 102 with a separate source of propellant material. In some cases, multiple types of propellant materials may be used in different portions of the ram accelerator assembly 102, such as a combination of diesel and air in a first portion and a combination of diesel and natural gas in a second portion. Independent of the source or type of propellant material used, the propellant material may apply a force to one or more projectiles to accelerate the projectile(s) toward workface. In some implementations, interactions between the projectile, force from the propellant material, and features of a tube or other portion of the ram accelerator assembly 102, may impart a ram effect to the projectile. For example, interior baffles or rails within a tube of the ram accelerator assembly 102, in conjunction with the exterior features of a projectile, may enable pressurized gas to accelerate a projectile using a ram effect. In some implementations, the projectile may achieve a ram velocity prior to exiting the ram accelerator assembly 102 and contacting a workface. In other implementations, the ram accelerator assembly 102 may not necessarily impart a ram effect to a projectile or cause the projectile to achieve a ram velocity.

The projectiles may have any shape and dimensions and may be formed from any type of material. In some implementations, the projectiles may be formed from concrete. In some implementations, the projectiles may have a wedge or tapered shape to facilitate penetration into a workface. Example implementations of ram accelerator assemblies, projectiles, and propellant materials are described with regard to the applications incorporated by reference previously.

In some implementations, the ram accelerator assembly 102 may be moved toward and away from a workface via one or more rails 104, or other sources of motive force, which may be engaged to the ram accelerator assembly 102 using one or more guides 106. In other implementations, the ram accelerator assembly 102 may be moved toward or away from a workface using wheels, tracks, treads, other sources of motive force, and so forth. For example, a trailer or other type of vehicle may be used as a source of motive force to transport the ram accelerator assembly 102 within a tunnel or shaft.

Interactions between a workface and projectiles that are accelerated using the ram accelerator assembly 102 may at least partially crack, weaken, break, or pulverize rock or other material at the workface. In some implementations, the ram accelerator assembly 102 may be selectively aimed or otherwise positioned to impact a particular portion of a workface. A reaming tool 108 may then be used to extend a hole created by a projectile, such as by removing material from and around the area of the workface affected by the impact. In some implementations, the reaming tool 108 may include a roadheader tool, which may scale and muck rock or other material that has been affected by a projectile impact. The reaming tool 108 may be associated with a boring assembly of the system 100, which in some implementations may include a vehicle, or other source of motive force, that is separate from the ram accelerator assembly 102. In other implementations, the reaming tool 108 may be associated with the same vehicle or other type of assembly as the ram accelerator assembly 102 and positioned relative to the ram accelerator assembly 102 such that the reaming tool 108 may contact a portion of a workface that was affected by a projectile impact. For example, the reaming tool 108 may be used to smooth or extend the edges of a crater created by an interaction between a projectile and the workface. Material that is weakened by an impact with one or more projectiles may be considerably easier to remove using mechanical energy, such as the rotational movement or other movement of a cutting head on the reaming tool 108, when compared to conventional boring using rotational movement of a drill or other type of reamer. Therefore, the wear on the cutting head of the reaming tool 108 and the mechanical rotational energy needed to remove material may be lower than the wear and energy associated with conventional boring operations.

In some implementations, the reaming tool 108 may be moved, oriented, aimed, and so forth, to contact a selected portion of a workface. For example, the reaming tool 108 may be oriented such that a cutting head thereof contacts a portion of the workface that was impacted by a projectile from the ram accelerator assembly 102. Continuing the example, FIG. 1 depicts the reaming tool 108 associated with a boom 110 that is in turn associated with a pivoting or articulating joint 112. The articulating joint 112 may enable the cutting surface(s) of the reaming tool 108 to be raised, lowered, and in some cases, moved in one or more lateral directions. In some implementations, the boom 110 may be extended and retracted (e.g., telescopically) to position the cutting surface(s) of the reaming tool 108 farther from or closer to the workface. The reaming tool 108 may also be moved toward or away from a workface using motive force. For example, the reaming tool 108 may include wheels 114, treads, tracks, or other structures to facilitate movement thereof. In other implementations, the reaming tool 108 may be engaged with rails, tracks, or other similar structures. While FIG. 1 depicts a single reaming tool 108, in other implementations, multiple reaming tools 108 may be used to extend a shaft or tunnel. The multiple reaming tools 108 may be associated with a single vehicle or boring assembly, or with multiple vehicles or assemblies. For example, multiple reaming tools 108 may be used to simultaneously bore through the same or different portions of a workface, such as to remove a large block of material from a workface.

In some implementations, a combination of projectile impacts and reaming tools 108 may be used to create a hole having dimensions larger than those of the reaming tool 108 or other equipment used to form a shaft or tunnel. For example, the ram accelerator assembly 102 may accelerate projectiles at an angle that is not parallel to the longitudinal axis of the tunnel or shaft, and the reaming tool 108 may be positioned to displace material from locations impacted by the projectiles. As a result, a hole having larger dimensions than the assemblies used to form the hole can be created without requiring conventional over-reamer mechanical systems.

A third assembly associated with the system 100 may include a collection assembly for collecting, transporting, displacing, or otherwise removing debris created by projectile impacts and by operations performed using the reaming tool 108 from the workface. In some implementations, a collection plate 116, or other type of member, may be associated with the collection assembly that includes the reaming tool 108. For example, FIG. 1 depicts a collection plate 116 as a ramp, platform, or other similar type of member positioned below the reaming tool 108 in a position proximate to the ground beneath the reaming tool 108. The collection plate 116 may catch or collect rock debris and other material from the workface created due to interactions between the workface and projectiles or the reaming tool 108. For example, the collection plate 116 may extend at a downward angle from the reaming tool 108 to contact or be positioned close to a floor of a shaft or tunnel, such that as the reaming tool 108 is advanced toward the workface, the collection plate 116 is advanced beneath debris or into debris that has fallen along the floor of the shaft or tunnel. In some implementations, the collection plate 116 may include an extension, arm, or other feature for removing rock or other material from the path of the boring assembly that includes the reaming tool 108, or other vehicles or assemblies, such as by leaving an undercut portion of a tunnel or shaft, which may prevent damage to components of the system 100. In some implementations, the collection plate 116 may be movable in vertical directions, such as to position the collection plate 116 closer to a floor of a shaft or tunnel, or to raise the collection plate to cause movement of collected debris toward a guide ramp 118, or other type of member, located behind the collection plate 116. For example, one or more joints 112 may also enable movement of the collection plate 116. In some implementations, the collection plate 116 may also be movable in one or more lateral directions. Additionally, in some implementations, the collection plate 116 may be movable inward or outward relative to the boring assembly that includes the reaming tool 108, such as through use of a boom 110 or another type of telescoping member. Movement of the boring assembly that includes the reaming tool 108 and collection plate 116 in a forward direction, such as through use of the wheels 114 or a similar member, may also be used to move the collection plate 116 closer to debris associated with a workface.

Movement of the collection plate 116 may move debris collected by the collection plate 116 toward the guide ramp 118. In some implementations, at least a portion of the collection plate 116 or guide ramp 118 may include a conveyor belt or other mechanism for imparting motive force to debris. In other implementations, one or more of the collection plate 116 or guide ramp 118 may be pivotable to shift debris away from the collection plate 116 and toward the guide ramp 118. In still other implementations, forward movement of the reaming tool 108 may function to move debris toward the guide ramp 118. In yet other implementations, the reaming tool 108, itself, or one or more arms associated with the collection plate 116 may be used to sweep debris and other materials into the connection plate 116, and in some cases toward the guide ramp 118. For example, the collection plate 116 may be associated with a wheeled or tracked system that is movable toward and away from a workface. In some implementations, the reaming tool 108 may be used to cause debris from selected portions of a tunnel to fall on or near the collection plate 116. For example, the reaming tool 108 may be positioned near or in contact with portions of a workface, floor, ceiling, or walls of a tunnel to sweep broken rock and other debris into or near the collection plate 116.

To facilitate removal of debris away from a workface, a collection trailer 120 or other type of movable receptacle may be positioned proximate to a rear end of the guide ramp 118. The collection trailer 120 may include a chute, trough, guide, or other similar structure that may be used to collect debris from the guide ramp 118. In some implementations, the chute, trough, or guide of the collection trailer 120 may impart motive force to debris, such as through use of a conveyor belt or similar device. For example, motive force associated with the collection trailer 120 may be used to move debris away from a workface and toward an entrance of a tunnel or shaft. In other implementations, the collection trailer 120 may be pivotable or angled to urge debris away from a workface using gravity. In still other implementations, the collection trailer 120 may be removed from a worksite using wheels, tracks, rails, or other mechanisms for enabling movement of the collection trailer 120, to enable the collection trailer 120 to be emptied and returned, or replaced with an additional collection trailer 120. In some implementations, the collection trailer 120 may be positioned behind the boring assembly that includes the reaming tool 108, and one or more protruding or overhanging portions extending from the collection trailer 120 may be positioned above the reaming tool 108, collection plate 116, or guide ramp 118, which may protect components thereof.

While FIG. 1 depicts the collection plate 116 and guide ramp 118 associated with the same assembly that includes the reaming tool 108, in other implementations, the collection plate 116 and guide ramp 118 may be associated with a separate assembly. Additionally, while FIG. 1 depicts the collection trailer 120 as a separate assembly from the collection plate 116 and guide ramp 118, in other implementations, the collection trailer 120, or another type of movable receptacle, may be part of the same assembly as the collection plate 116 and guide ramp 118. Any combination of the components described with regard to FIG. 1 may be combined in any number of assemblies. For example, the ram accelerator assembly 102 may be engaged with the collection trailer 120, the boring assembly that includes the reaming tool 108, and so forth. As such, while FIG. 1 depicts the ram accelerator assembly 102, reaming tool 108, and collection trailer 120 as discrete components, in various implementations, one or more of the components may be engaged with one another. For example, the reaming tool 108 may include a motor or other source of motive force and may be used to pull one or more of the collection trailer 120 or the ram accelerator assembly 102. In other cases, the ram accelerator assembly 102 and collection trailer 120 may be separate from the reaming tool 108 and may be associated with a vehicle, a motor, or another source of motive force.

The system 100 shown in FIG. 1 may enable efficient and generally continuous boring operations by using accelerated projectiles from one or more ram accelerator assemblies 102 to at least partially weaken a working face, a reaming tool 108 to remove debris from an area of the workface affected by the projectiles, and a collection assembly and collection trailer 120 to remove debris from proximate to the workface while operation of the ram accelerator assembly 102 and reaming tool 108 is performed.

While FIG. 1 depicts a single ram accelerator assembly 102, reaming tool 108, and collection trailer 120, in other implementations, an autonomous fleet that includes multiple vehicles may be used to more efficiently bore through a single workface. Additionally, multiple fleets of vehicles at multiple worksites may be coordinated remotely. For example, one or more of the ram accelerator assembly 102, reaming tool 108, or collection trailer 120 may be operated remotely or autonomously, without requiring personnel at a worksite.

In some implementations, the ram accelerator assembly 102 may be selectively used to bore through hard rock and similar materials, while the reaming tool 108 may be used independent of the ram accelerator assembly 102 to bore through softer materials, such as sand or lower strength rock. Use of the ram accelerator assembly 102 and reaming tool 108 selectively, to maximize one or more of stability (e.g., integrity of the walls or ceiling of a tunnel or shaft), speed, or cost may be controlled remotely or autonomously. Additionally, in some implementations, unintentional acceleration of projectiles by the ram accelerator assembly 102 or acceleration of projectiles by the ram accelerator assembly 102 that may not be beneficial may be prevented through use of one or more computing devices or other autonomous controls. For example, a controller associated with ram accelerator assembly 102 may be configured to only cause the ram accelerator assembly 102 to accelerate projectiles when a "heart-beat" signal is has been received from a computing device. In some implementations, a computing device or controller associated with the ram accelerator assembly 102 may be provided with one or more criteria, such as pressure, inclination, magnetic characteristics, or other types of digital or mechanical measurements. The ram accelerator assembly 102 may be prevented from actuation (e.g., acceleration of projectiles to impact a workface) if selected criteria are not met, or prevented from actuation if certain criteria are present, which may prevent acceleration of projectiles if the ram accelerator assembly 102 is not in a proper location or if use of projectile impacts may not provide a significant benefit. In some implementations, the ram accelerator assembly 102 may be associated with accelerometers, laser ring gyros, a GPS, radio guidance systems, imaging systems (e.g., optical systems, cameras, etc.), and so forth, to enable a remote user or autonomous system to determine an optimal time to accelerate a projectile, and to aim the accelerated projectile at a particular portion of a workface. Use of computer-controlled components may improve accuracy when the ram accelerator assembly 102 is used, such as enabling a projectile to accurately impact a workface even while portions of the system 100 are moving.

In some implementations, an acoustic signal generated by an impact between a projectile and a workface may be used to determine characteristics of rock or other material, which may be used to control the direction in which a tunnel or shaft is extended. For example, a tunnel or shaft may be preferentially extended toward rock having greater porosity or a lower density to facilitate faster boring operations, toward or away from subterranean water, and so forth. Example systems and methods for determining acoustic signals generated by projectile impacts and controlling extension of shafts based on this information are described in U.S. patent application Ser. No. 15/871,824, incorporated by reference previously.

Figure 2:
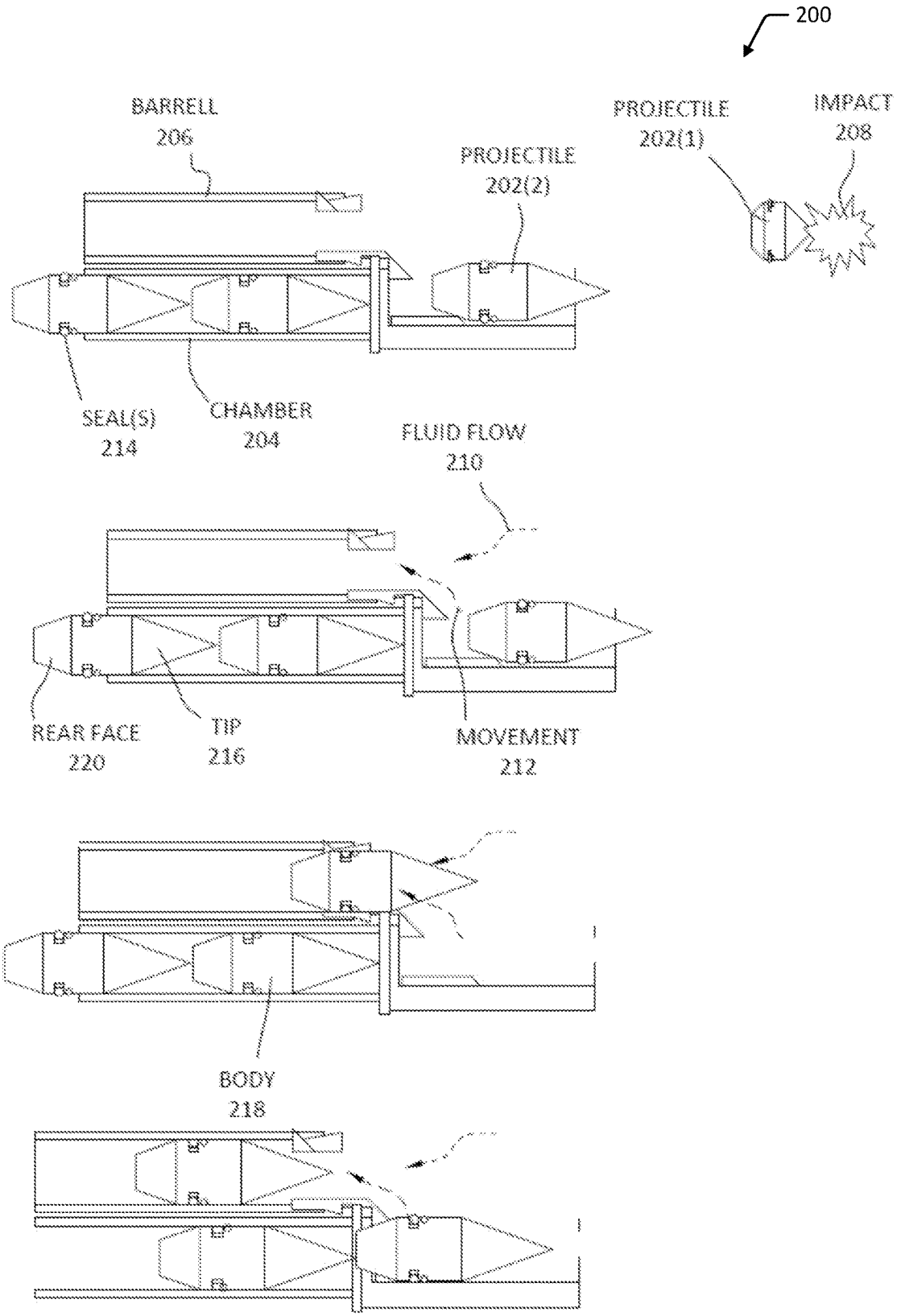
FIG. 2 depicts an implementation of a method by which projectiles may be moved from a chamber used to house the projectiles into a barrel from which the projectiles may be accelerated toward a workface.

FIG. 2 depicts an implementation of a method 200 by which projectiles 202 may be moved from a chamber 204 used to house the projectiles 202 into a barrel 206 from which the projectiles 202 may be accelerated toward a workface. Impacts 208 between a projectile 202 and a workface may create a fluid flow 210 that causes movement of other projectiles 202 from the chamber 204 toward the barrel 206.

Specifically, FIG. 2 depicts an impact 208 between a first projectile 202(1) and a workface, which may create a fluid flow 210, in which fluid is directed toward an opening in the barrel 206 from which the projectile 202(1) exited the barrel 206. The fluid flow 210 may move a second projectile 202(2) from a position in front of the chamber 204 toward the front of the barrel 206, as indicated by an arrow representing the movement 212 of the second projectile 202(2). The movement 212 of the fluid and second projectile 202(2) may seat the second projectile 202(2) within the barrel 206, such that one or more seals 214 associated with the projectile 202(2) engage the inner diameter of the barrel 206. In some implementations, the seals 214 of the projectile(s) 202 may also engage the inner diameter of the chamber 204 when the projectile(s) 202 are positioned therein. After the second projectile 202(2) is seated in the barrel 206, actuation of a propellant material within the barrel 206 may accelerate the second projectile 202(2) toward the workface to generate an impact 208, which may in turn cause fluid flow 210 to facilitate movement of an additional projectile 202 into the barrel 206. In some implementations, the fluid flow 210 may cause a flapper valve or other type of closure mechanism associated with the chamber 204 or barrel 206 to close to prevent excess fluid, debris, or air from entering the chamber 204 or barrel 206.

While FIG. 2 depicts an implementation in which fluid flow 210 moves projectiles 202 toward a front of the barrel 206, in other implementations, projectiles 202 may be moved toward a back end of the barrel 206, or a side opening of the barrel 206 (e.g., breech loading). Additionally, while FIG. 2 depicts movement of projectiles 202 from a chamber 204 to a barrel 206, in other implementations, a slurry of projectiles 202 may be pumped through tubes toward the barrel 206 of the ram accelerator assembly 102. In still other implementations, one or more projectiles 102 may be generated on-site. For example, the ram accelerator assembly 102 or another assembly associated with the system 100 may fill a plastic container or other type of container with concrete, another curable material, or a dense liquid, and the filled container may be used as a projectile 202.

In some implementations, one or more of the projectiles 202 may include a tapered tip 216 to facilitate penetration into a workface. Projectiles 202 may also include a generally cylindrical body 218, and a rear face 220 that facilitates acceleration of the projectile 202 and reduces drag. In some implementations, characteristics of the projectiles 202, such as exterior features of the body of a projectile 202, may interact with characteristics of the barrel 206 to produce a ram effect as the projectile(s) 202 are accelerated through the barrel 206.

In some implementations, one or more of the ram accelerator assembly 102, reaming tool 108, or collection trailer 120 may be operated under a gas or liquid pressure, such as under water, within drilling mud, or in pressurized air, which may increase the buoyancy of debris and conveyance of the debris away from the workface. Increased pressure may also facilitate the stability of a tunnel or shaft, reducing or eliminating a need for rock bolting or other types of ground support. For example, rock and other materials may be more buoyant when submerged in water, drilling mud, or pressurized air, which may enable components of an assembly for conveying debris away from a workface to be lighter and to operate using less force and energy. Additionally, operation of portions of the system 100 within a fluid may reduce or eliminate the need to empty a tunnel of water. Reducing or eliminating the need for water discharge operations may increase efficiency and lower costs related to the extension of a tunnel or shaft. Further, the system 100 may be used in a sloped area (e.g., an incline or a decline), to extend a horizontal tunnel or shaft, or to extend a curved tunnel or shaft. Use of projectiles 202 accelerated using the ram accelerator assembly 102 may enable projectiles 202 to accurately impact a targeted location even when used under pressure, within a fluid, and so forth. For example, while a projectile 202 may lose velocity when traveling through certain media, a projectile 202 accelerated using a ram accelerator assembly 102 may maintain sufficient velocity to accurately impact a target.

In some implementations, tunnel stabilization mechanisms, such as a rock bolting tool for placing rocks bolts, nails, or other stabilizing structures into a wall of a tunnel, a shotcreting tool for providing concrete, mortar, or other materials to a tunnel wall, or other types of tools may be incorporated into one or more of the ram accelerator assembly 102, reaming tool 108, or collection trailer 120. Use of bolting and shotcreting tools, or other types of tunnel stabilization mechanisms, may allow a continuous mining, tunneling, or boring operation to be performed by enabling stabilization and ground support processes to be performed at least partially simultaneously with the acceleration of projectiles, boring of a tunnel or shaft using a reaming tool 108, and removal of debris using the collection plate 116 and other portions of the collection assembly.

Figure 3:
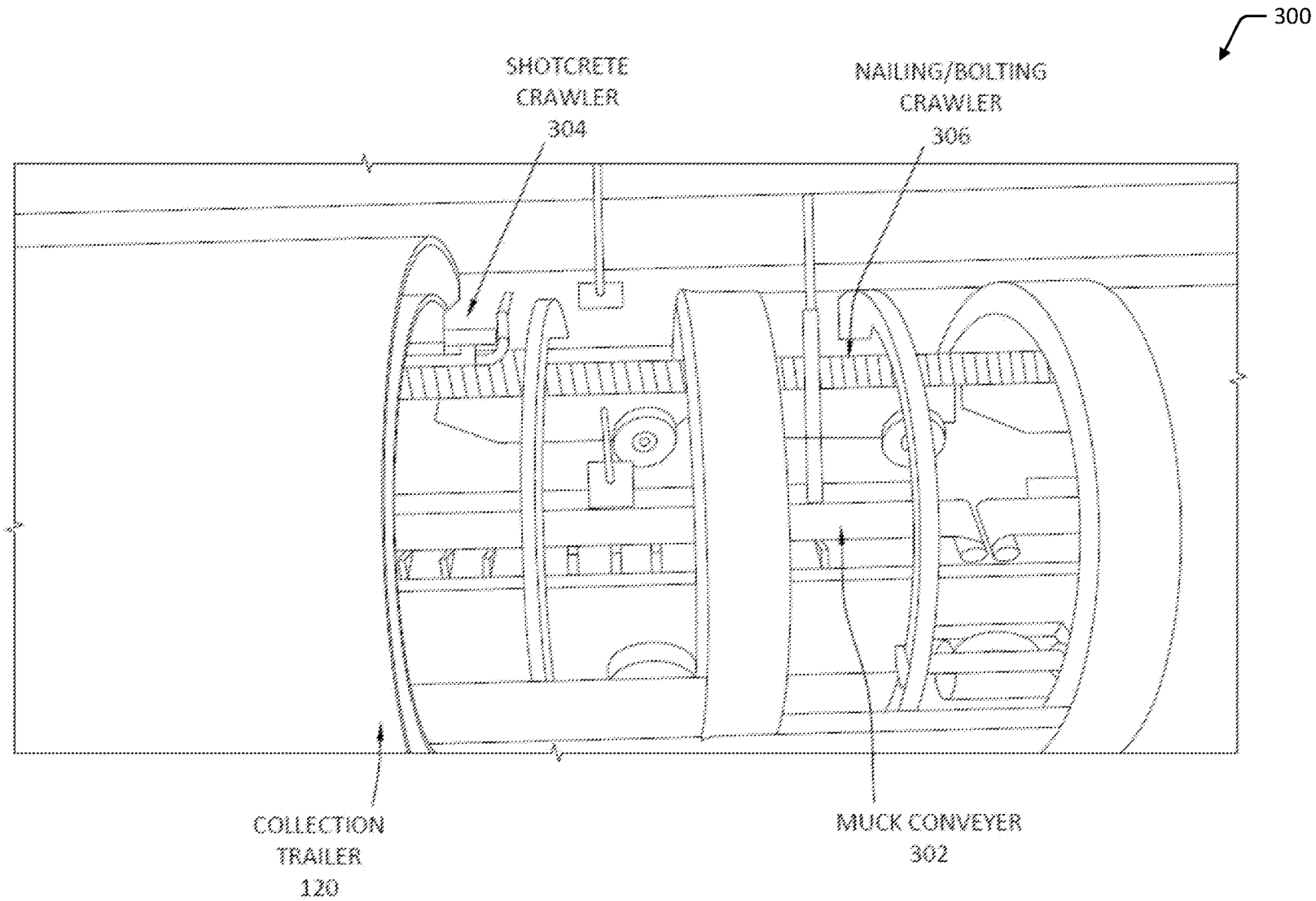
FIG. 3 depicts a top view of an implementation of a system that includes additional assemblies for conveying debris and stabilizing a tunnel or shaft.
Figure 4:
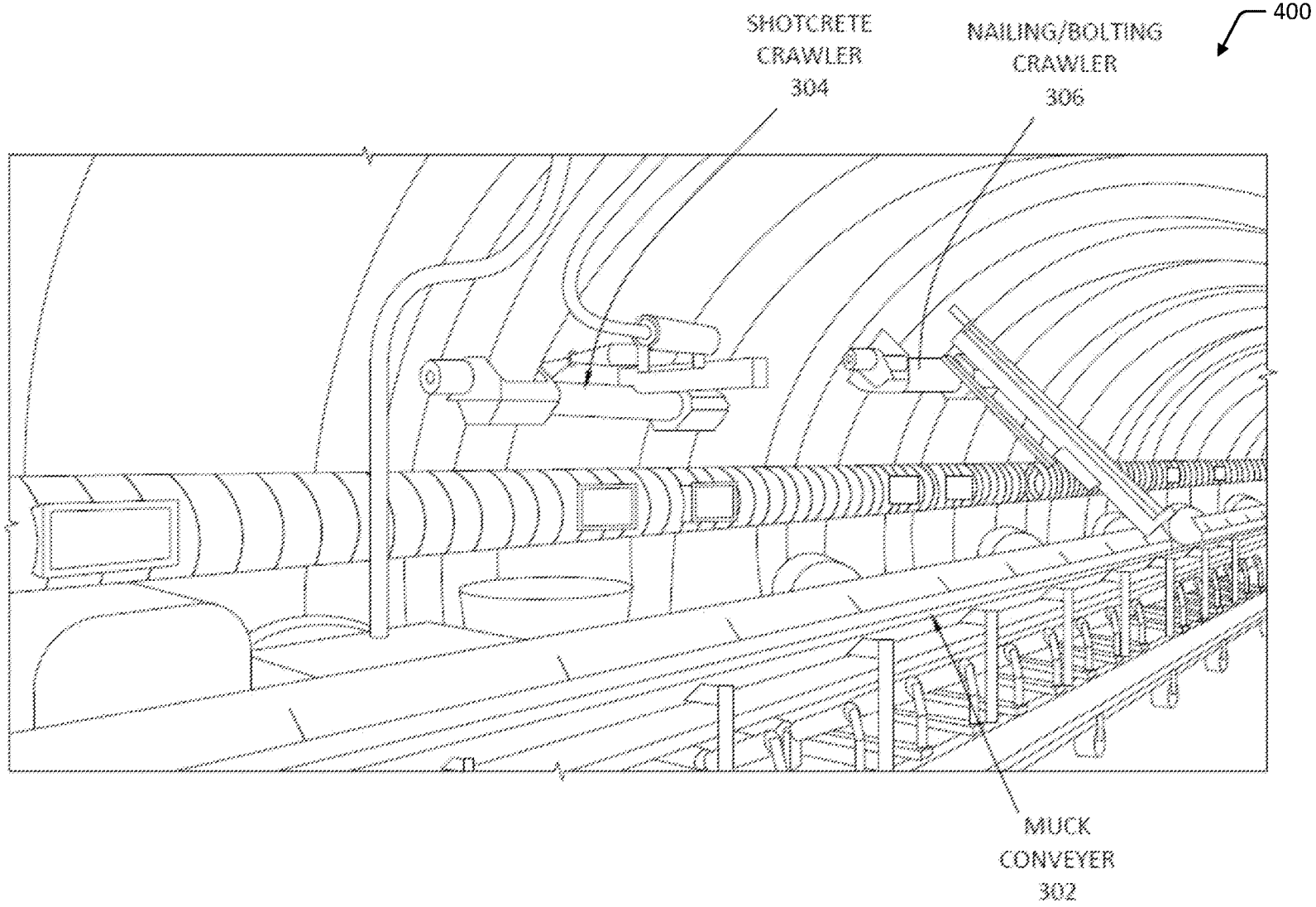
FIG. 4 depicts a perspective view of an implementation of a system that includes additional assemblies for conveying debris and stabilizing a tunnel or shaft.

For example, FIG. 3 and FIG. 4 depict example systems 300, 400, in which the collection trailer 102 includes a muck conveyor 302 used to move debris away from a workface, and a shotcrete crawler 304 and nailing/bolting crawler 306 engaged with guided structures above the muck conveyor 302. The muck conveyor 302 may include a chute, ramp, or other structure for guiding debris away from a workface. In some implementations, the much conveyor 302 may include a conveyor belt or other system for providing motive force to debris. The shotcrete crawler 304 and nailing/bolting crawler 306 may perform stabilizing operations within a tunnel or shaft as the collection trailer 120 is advanced within the tunnel or shaft. Specifically, the nailing/bolting crawler 306 may be used for bolting operations, while the shotcrete crawler 304 may be used to provide mortar or other stabilizing materials within the tunnel. While FIG. 3 and FIG. 4 depict the shotcrete crawler 304 and nailing/bolting crawler 306 being associated with an assembly for removal of debris from a workface, in other implementations, the shotcrete crawler 304, nailing/bolting crawler 306, or other tools or assemblies may be associated with the ram accelerator assembly 102, the assembly that includes the reaming tool 108, or separate assemblies or vehicles.

In some implementations, one or more of the assemblies for performing continuous tunneling, boring, or mining operations described with regard to FIG. 1 may be combined or incorporated in different manners. For example, the reaming tool 108 and ram accelerator assembly 102 may be incorporated within a single assembly.

Figure 5:
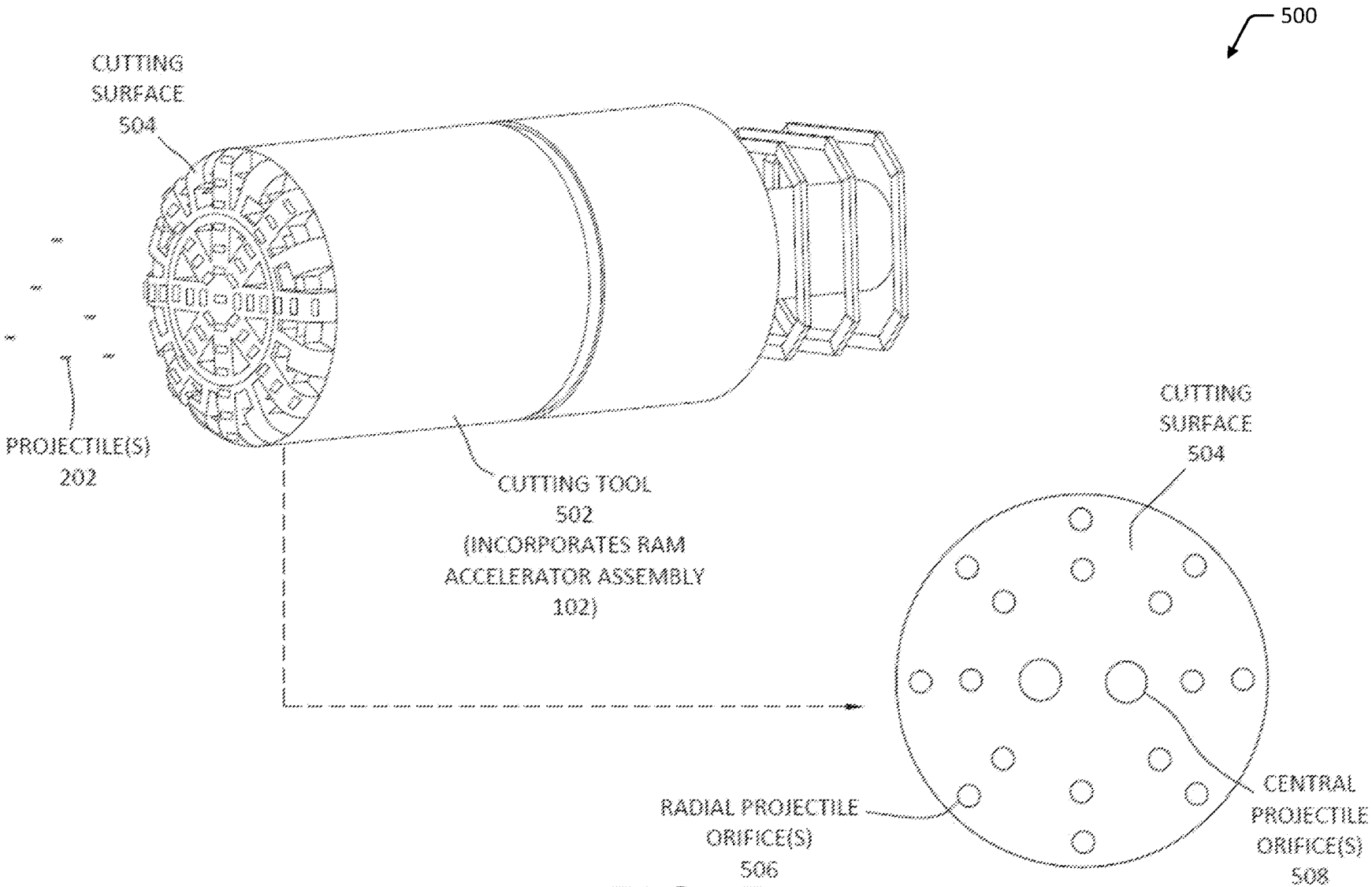
FIG. 5 is a series of diagrams depicting an implementation of a cutting tool that may be used in conjunction with a ram accelerator assembly to extend a shaft or tunnel using a combination of projectile impacts and boring operations.

FIG. 5 is a series of diagrams 500 depicting an implementation of a cutting tool 502 that may be used in conjunction with a ram accelerator assembly 102 to extend a shaft or tunnel using a combination of projectile impacts and boring operations. In some implementations, the cutting tool 502 may include a drill bit, such as a rock bit, coring bit, or other type of drill bit having one or more cutting elements that are brought into contact with rock or other material, and that cut or displace the material through rotation of the drill bit. For example, the cutting tool 502 is shown having a generally cylindrical body with a cutting surface 504 at an end thereof. The cutting surface 504 may include one or more cutting elements that cut, ream, or otherwise displace rock or other material adjacent to the cutting surface 504 as the cutting surface 504 is rotated. The cutting surface 504 may also include one or more orifices through which projectiles 202 may be accelerated into contact with a workface adjacent to the cutting surface 504. For example, one or more ram accelerator assemblies 102 may be incorporated within the body of the cutting tool 502.

Continuing the example, FIG. 5 depicts a diagrammatic front view of the cutting surface 504 in which a series of orifices through which accelerated projectiles 202 may pass through the cutting surface 504. In some implementations, each orifice may be associated with a ram accelerator assembly 102. In other implementations, a single ram accelerator assembly 102 may be configured to accelerate projectiles 202 through multiple orifices.

Specifically, FIG. 5 depicts an implementation in which a series of radial projectile orifices 506 are generally evenly spaced about a circumference of the cutting surface 504. The cutting surface 504 is shown including an outer ring of eight radial projectile orifices 506 and an inner ring of eight radial projectile orifices 506 positioned inward relative to the outer ring. The cutting surface 508 is also shown including two central projectile orifices 508, which in some implementations may have a larger diameter than that of the radial projectile orifices 506. For example, projectiles 202 accelerated through the central projectile orifice(s) 508 may have one or more dimensions greater than projectiles 202 accelerated through the radial projectile orifice(s) 506.

In some implementations, the particular orifices through which projectiles 202 are accelerated may be selected based on the characteristics of the material through which the cutting tool 502 is penetrating, the direction in which a tunnel or shaft is extended, the rate at which it is desired to extend a tunnel, and so forth.

Figure 6:
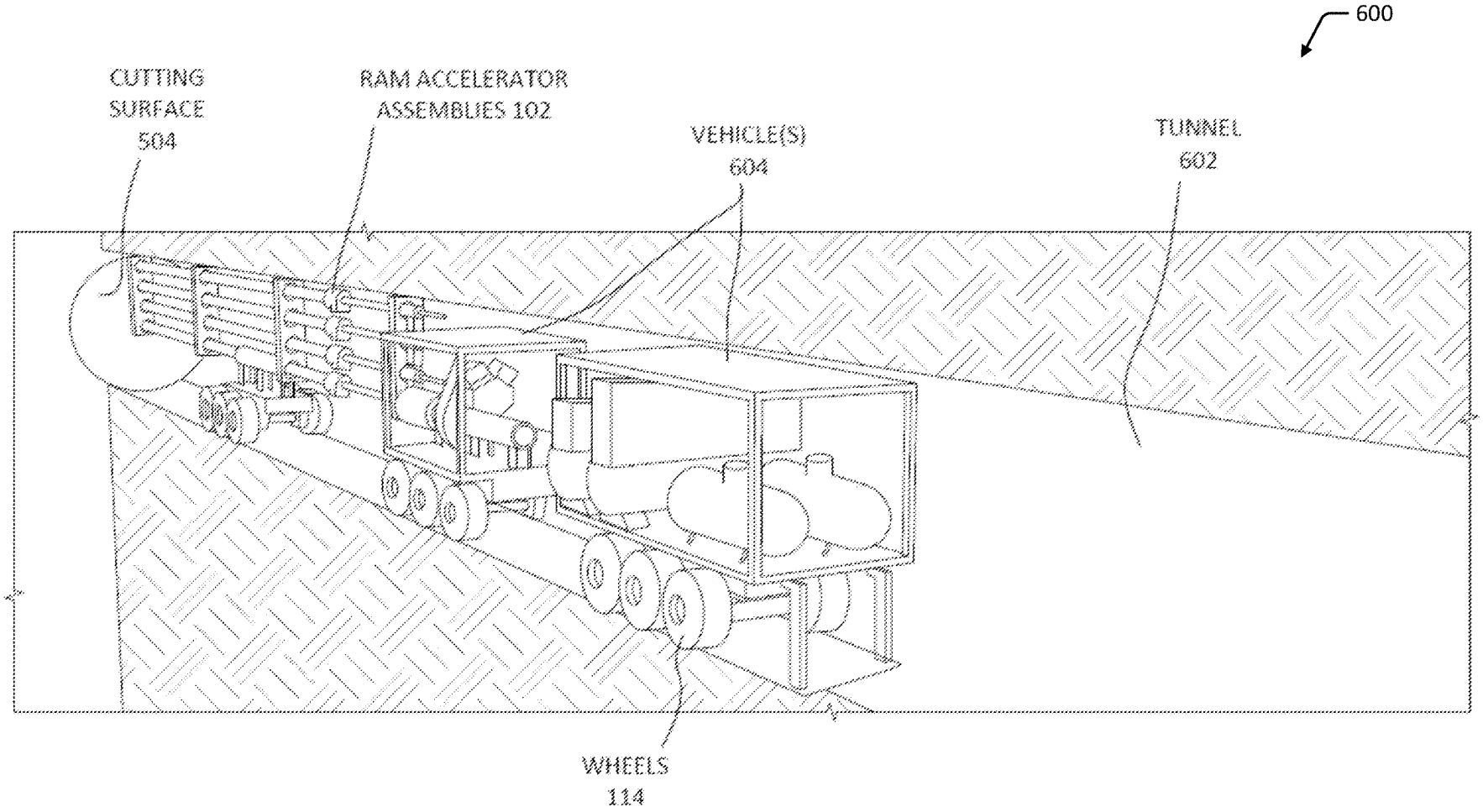
FIG. 6 is a diagram depicting a system for extending a tunnel using multiple ram accelerator assemblies in combination with the cutting surface of a cutting tool.

For example, FIG. 6 is a diagram 600 depicting a system for extending a tunnel 602 using multiple ram accelerator assemblies 102 in combination with the cutting surface 504 of a cutting tool 502. In FIG. 6, the body of the cutting tool 502 is not shown to enable visualization of the position of the cutting surface 504 and ram accelerator assemblies 102. FIG. 6 depicts four ram accelerator assemblies 102 arranged in a row. In some implementations, the cutting surface 504 may rotate relative to the ram accelerator assemblies 102, and when orifices in the cutting surface 504 are aligned with the ram accelerator assemblies 102, at least a portion of the ram accelerator assemblies 102 may be actuated to accelerate one or more projectiles 202 through the orifices.

FIG. 6 depicts one or more additional vehicles 604 associated with the cutting tool 502 and ram accelerator assemblies 102. For example, the ram accelerator assembly 102 may be advanced through the tunnel 602 using wheels 114, tracks, rails, and so forth, and the vehicles 604 may similarly include wheels 114 or another mechanism for advancement through the tunnel 602. In some cases, the vehicles 604 may be associated with assemblies that support use of the cutting tool 502 or ram accelerator assemblies 102, such as assemblies that provide projectiles 202 and propellant materials into the ram accelerator assemblies 102. Additionally, in some cases, the vehicles 604 may be associated with assemblies for collecting and removing debris created by interactions between the cutting surface 504 or the projectiles 202 and a workface.

In some implementations, the specific ram accelerator assemblies 102 that are actuated may be selected based on a desired direction in which to extend the tunnel 602. For example, repeatedly accelerating projectiles 202 toward one side of the cutting surface 504 may cause the tunnel 602 to be extended in an opposing direction due to the force exerted by the acceleration of the projectiles 202 and the interaction between the projectiles 202 and one side of the tunnel 602. In other implementations, the specific ram accelerator assemblies 102 that are actuated may be selected based on the characteristics of the material through which the cutting surface 504 is penetrating, a desired rate of penetration, and so forth. For example, a smaller number of ram accelerator assemblies 102, and in some cases zero ram accelerator assemblies 102, may be actuated at times when a sufficient rate of penetration may be achieved using the cutting tool 502.

Figure 7:
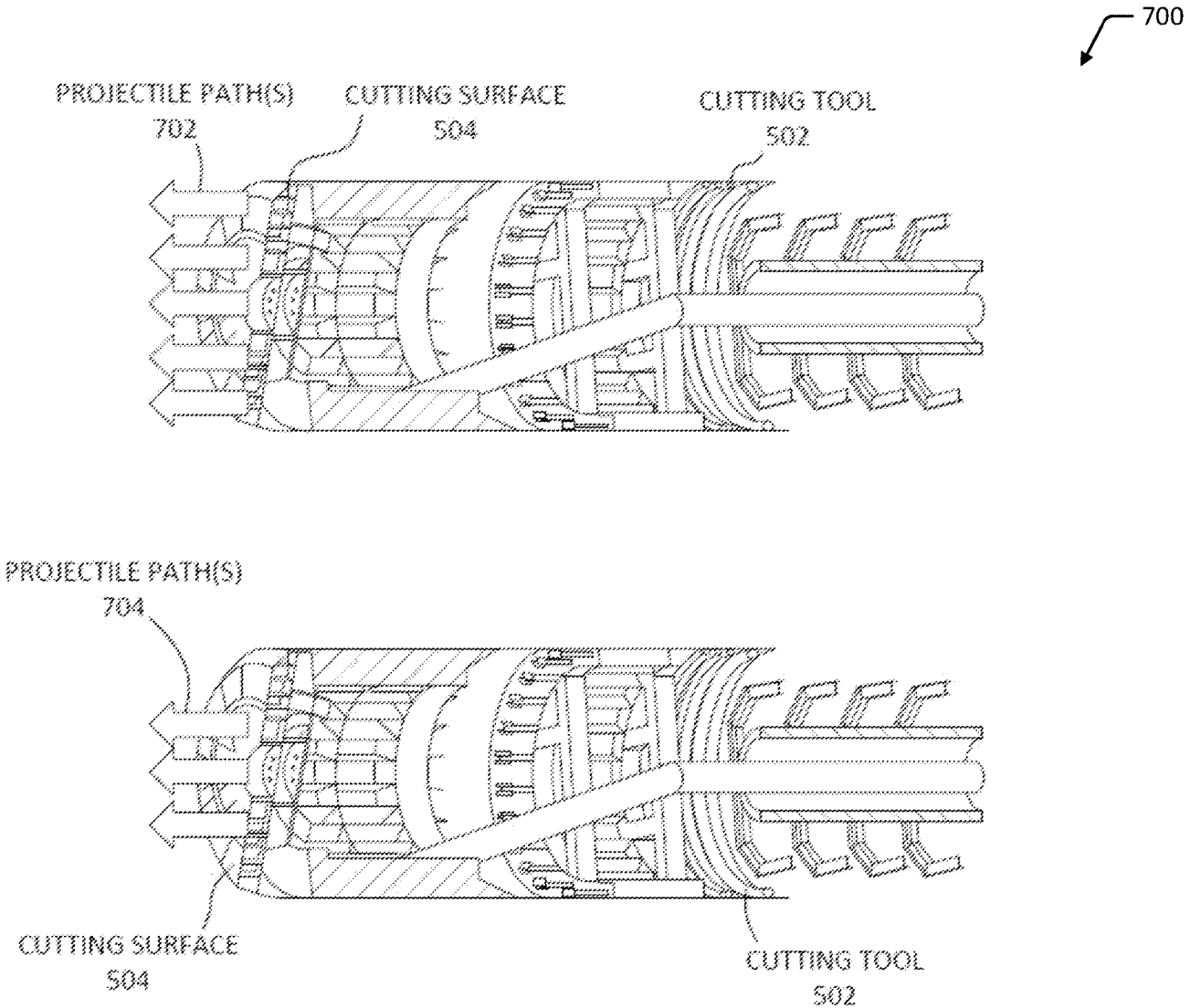
FIG. 7 is a series of diagrams depicting example implementations in which different numbers or configurations of ram accelerator assemblies may be used based on the characteristics of a workface, a desired rate of penetration, or a desired shape of penetration.

FIG. 7 is a series of diagrams 700 depicting example implementations in which different numbers or configurations of ram accelerator assemblies 102 may be used based on the characteristics of a workface, a desired rate of penetration, or a desired shape of penetration. In a first diagram, a large portion of a workface in front of the cutting surface 504 may be affected by projectile impacts by actuating a large number of ram accelerator assemblies 102 associated with the cutting tool 502, as illustrated by a first set of projectile paths 702. In such a case, a large portion of a rock face or other type of workface may be impacted by multiple projectiles 202, which may substantially weaken a large portion of the workface. In a second diagram, a selected subset of ram accelerator assemblies 102 may be actuated, as illustrated by a second set of projectile paths 704, which may weaken a selected portion of a workface. Weakening of a selected portion of a workface using projectile impacts may be used to control the rate of penetration through a material, the shape of a tunnel 602 formed in the material, the direction in which a tunnel 602 is extended, and so forth. For example, interaction between a cutting surface 504 and a first portion of a workface that has not been weakened by a projectile impact may cause the path of the cutting tool 502 to be diverted way from the first portion of the workface, and toward a second portion of the workface that has been weakened by a projectile impact. Projectile impacts may also be used to selectively impact the center of a workface, the edges of a workface, or other portions of a workface.

For example, a portion of a workface, such as the percentage of an area of a hole, that is to be weakened by projectiles 202 may be selected, while the remainder of the workface may remain to be removed using drilling or boring operations using a cutting surface 504. The portion of the workface that is weakened by projectiles 202 may be selected based on the rate at which a tunnel 602 or shaft may be extended using a cutting tool 502 and the rate at which debris may be removed from a workface. For example, if a tunnel 602 is extended at a rate that enables debris to accumulate more rapidly than the debris may be removed, use of projectiles 202 to weaken the workface may be limited to conserve materials and slow the rate of penetration through a workface, preventing undesired accumulation of debris.

For example, projectiles 202 may be accelerated using radial projectile orifices 506 associated with a cutting surface 504, creating a disc-shaped region of a workface that is affected by projectile impacts, while leaving a central portion of the workface unaffected by projectile impacts.

Figure 8:
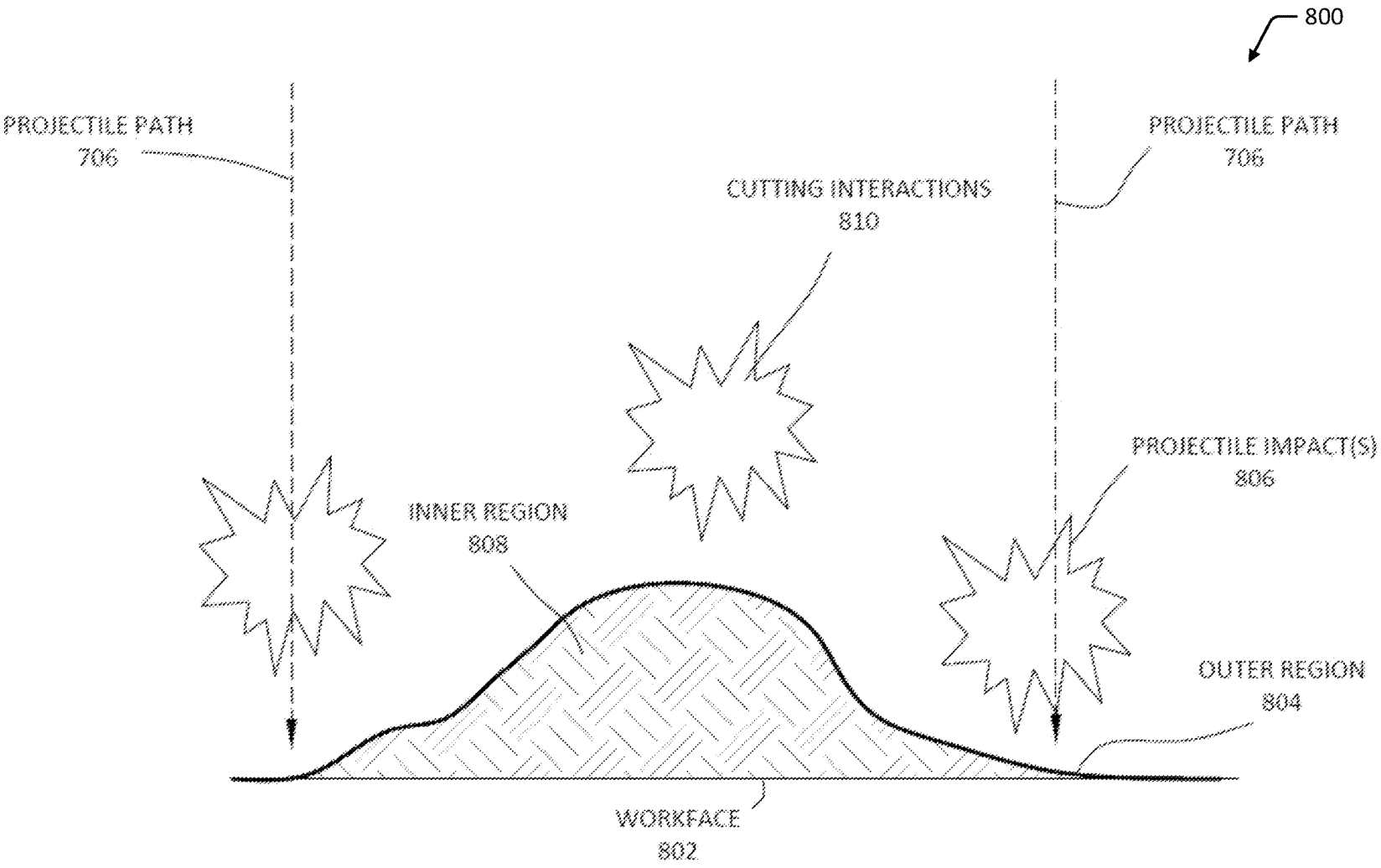
FIG. 8 is a diagram depicting a workface in which an outer region has been affected by one or more projectile impacts, as illustrated by projectile paths, while an inner region is not affected by projectile impacts.

FIG. 8 is a diagram 800 depicting a workface 802 in which an outer region 804 has been affected by one or more projectile impacts 806, as illustrated by projectile paths 706, while an inner region 808 is not affected by projectile impacts 806. As a result, the inner region 808 may primarily be impacted by the cutting surface 504 of a cutting tool 502, as illustrated by the region of FIG. 8 labeled "cutting interactions" 810. In some implementations, a disc-shaped cutting surface 504 having a diameter perpendicular to the workface 802 may be used to remove material from the workface 802. In such a case, projectiles 202 accelerated as illustrated by the projectile paths 706 may break or condition material on both sides of the area where the disc-shaped cutting surface 504 may contact the workfare 802, which may reduce stress on both sides of the disc-shaped cutting surface 504.

In some implementations, one or more of the systems described with regard to FIGS. 1-8 may be used in conjunction with a mobile (e.g., self-driven or autonomously-controlled) tunneling unit. Traditional tunnel boring machines (TBMs) include round cutterheads and use rotary torque to carve through rock or other material. An excavation process that uses TBMs typically creates a concentric hole, limiting applications into a single cross-section type and ultimately producing a profile with a low utilization ratio of tunneled sections. In cases where a project requires a finished tunnel cross-section that is not circular (such as rectangular or other shapes), a secondary excavation operation is typically used to provide the desired cross-section. The additional equipment, labor, and time associated with a secondary excavation operation can exponentially increase the time, cost, and other resources associated with forming a tunnel. Implementations described herein may enable tunnels to be formed and conditioned, such as through trenchless excavation operations, and may provide tunnels with cross-sectional shapes that are circular or non-circular, with a significantly higher utilization ratio for tunnel sections than conventional excavation operations. In some implementations, the techniques described herein may be used to form a tunnel having varying geometry (e.g., a tunnel that changes in diameter or cross-sectional shape as a function of length). Additionally, use of techniques described herein may enable tunnels to be formed and conditioned with significantly less time and cost when compared to conventional excavation operations.

In some implementations, such a tunneling unit may use water jet cutters, or other media or devices, to precondition a surface, while ram accelerator assemblies 102 may be used to break rock or other materials by accelerating projectiles 202 into contact with the material. In some implementations, the water jet cutters and ram accelerator assemblies 102 may be controlled remotely, and in some cases may be articulated or aimed in a variety of positions. As described previously, a ram accelerator assembly 102 may weaken, break, degrade, or otherwise affect rock or other materials, which may enable other tools to more effectively displace the material. Additionally, while the ram accelerator assembly 102 is described using the term "ram accelerator", a rail gun, gas gun, or other method of providing force to projectiles 202 may also be used. As described previously, a ram accelerator assembly 102 may include a tubular body having a propellant or other source of motive force, such as a gas gun, positioned in association therewith, such that force from pressurized or combustible gas may move a projectile 202 within the tubular body. Then, interactions between the projectile 202 and the tubular body may further accelerate the projectile 202 toward a rock face or other material. Interactions between the projectiles 202 and rock or other material may break the material into a desired cross-sectional shape. In some implementations, a surface may be preconditioned prior to impact with one or more projectiles 202 to control the manner in which projectile impacts cause the material to break or otherwise be affected.

Figure 9:
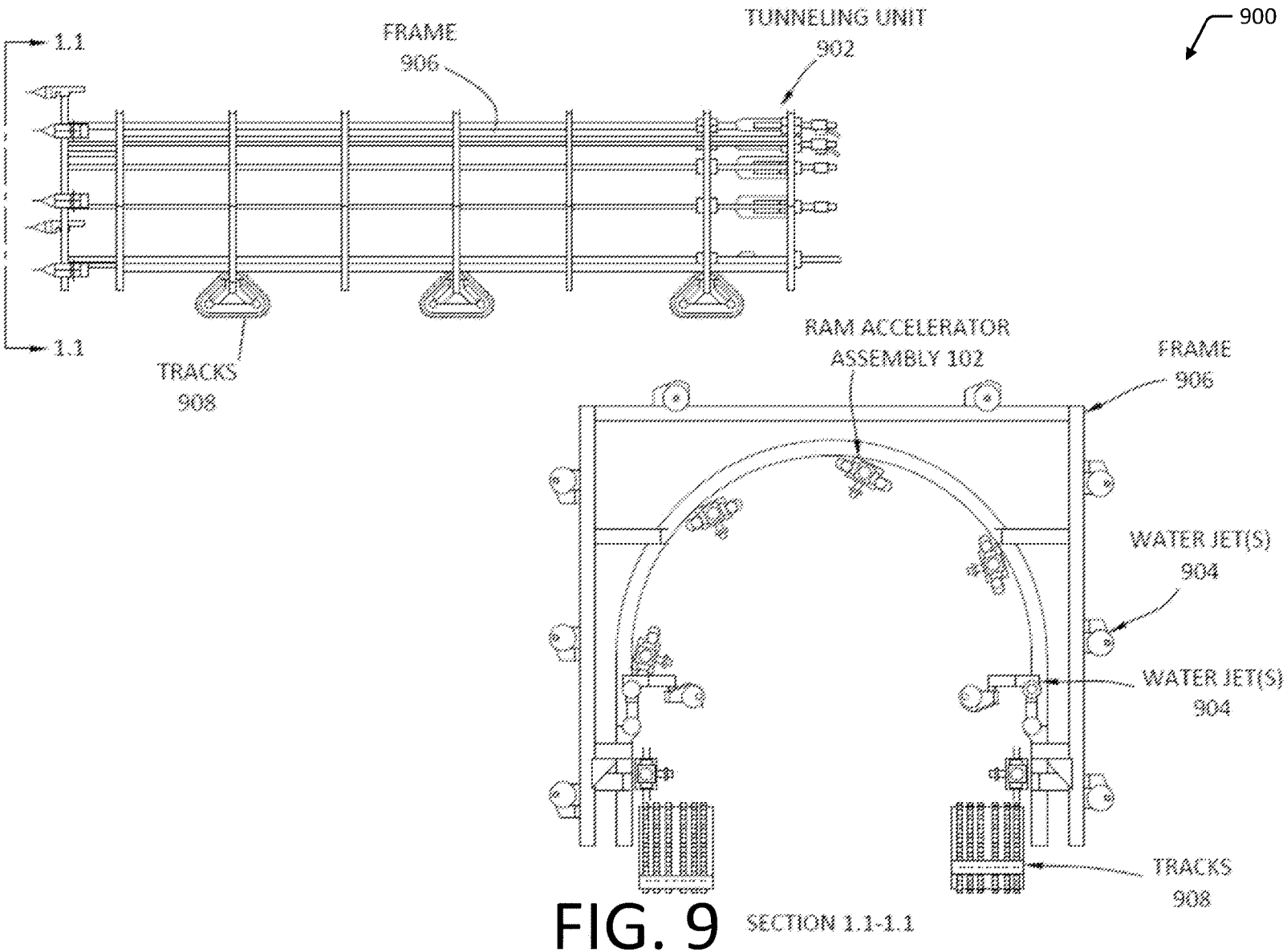
FIG. 9 is a series of diagrams illustrating an implementation of a tunneling unit that may be used to condition a surface and displace material from the surface using a combination of water jets and ram accelerator assemblies.

FIG. 9 is a series of diagrams 900 illustrating an implementation of a tunneling unit 902 that may be used to condition a surface and displace material from the surface using a combination of water jets 904 and ram accelerator assemblies 102. The tunneling unit 902 may include a structural frame 906 that is movable forward and backward (e.g., to advance further into and out from a tunnel 602) using tracks 908. In other implementations, wheels, skids, rollers, or other methods for enabling movement of the tunneling unit 902 may be used. In some implementations, movement of the tunneling unit 902 may be controlled remotely. In some implementations, the tunneling unit 902 may be configured for automatic movement, such as automatic advancement deeper into a tunnel after use of the tunneling unit 902 to form a segment of a tunnel 602.

Multiple water jets 904 may be mounted on the structural frame 906. In some implementations, the water jets 904 may include articulating water jet heads (e.g., water jet cutters). In other implementations, other types of cutting, reaming, or boring tools may be used to pre-condition a surface in addition to or in place of the water jets 904. One or more ram accelerator assemblies 102 may also be mounted to the structural frame 906. FIG. 9 depicts the structural frame 906 having an outer frame with a generally rectangular shape, upon which the water jets 904 are mounted, and an inner frame having a generally semicircular shape, upon which the ram accelerator assemblies 102 are mounted. However, in other implementations, frames having any shape may be used. For example, water jets 904 may be positioned along an outer frame having a semicircular shape, or another desired shape. As another example, both water jets 904 and ram accelerator assemblies 102 may be positioned along a single frame having a rectangular shape, a semicircular shape, or another shape, and use of separate inner frames and outer frames may be omitted.

In some implementations, as shown in FIG. 9, the water jets 904 may be mounted at a leading (e.g. front) edge of the tunneling unit 902, while the ram accelerator assemblies 102 are mounted behind the water jets 904, such as at or near a trailing (e.g., rear) edge of the structural frame 906. In some implementations, a rack system may allow each water jet 904 to move independently, articulate, and achieve multiple different positions or orientations to project water toward a surface. Each water jet 904 may include an actuator, and in some implementations, may be programed to move automatically, independent of other water jets 904. For example, a particular water jet 904 may be programmed to run a set task that includes articulating to one or more positions, use of one or more travel rates, feed or flow rates, and other operational parameters. Continuing the example, a tunneling unit 902 having multiple water jets 904 may be programmed to use the water jets 904, in conjunction with one another, to pre-condition rock or other material for formation of a section of a tunnel 602.

In some implementations, the tunneling unit 902 may include one or more additional water jets 904 located toward the bottom of the tunneling unit 904 that may be attached to movable arms. In some implementations, such a water jet 904 may be mounted on a six-axis robotic arm, which may allow the water jet 904 to be positioned and oriented in a nearly-infinite number of ways to provide water toward rock or other material. In other implementations, other types of arms or movable members, including arms with greater or fewer than six axes, may be used. As the tunneling unit 902 is advanced into a tunnel 602, these water jets 904 may precut a lower portion of a tunnel profile, then be moved out of position as needed for other operations.

In some implementations, the water jets 904 may be used to cut an initial outer profile for a tunnel section. In other implementations, the water jets 904 may be used to cut other patterns to pre-condition or weaken a rock face or other material. After cutting an initial outer profile, the ram accelerator assemblies 102, which in some implementations may be articulated, aimed, and so forth, may be used to accelerate projectiles 202 into the rock or other material, within the outer profile, to pulverize the material. In some implementations, each ram accelerator assembly 102 may be associated with a track 908 or other mechanism to enable movement thereof, and may be moved, pivoted, and articulated to provide projectiles to selected positions in the rock or other material. As the rock or other material is broken by projectile impacts, mucking operations, such as those described with regard to FIG. 1, may be used to transport the material out from the newly-formed tunnel section. The tunneling unit 902 may then be moved forward into the newly-formed tunnel section, and the process may be repeated to extend the tunnel 602. In some implementations, the tunneling unit 902 may be continuously advanced as sections of a tunnel 602 are formed. Extension of the tunnel 602 by repeating this process may be used to provide a subsequent tunnel section having the same cross-sectional shape and diameter, or a different (or variable) cross-sectional shape or diameter.

Figure 10:
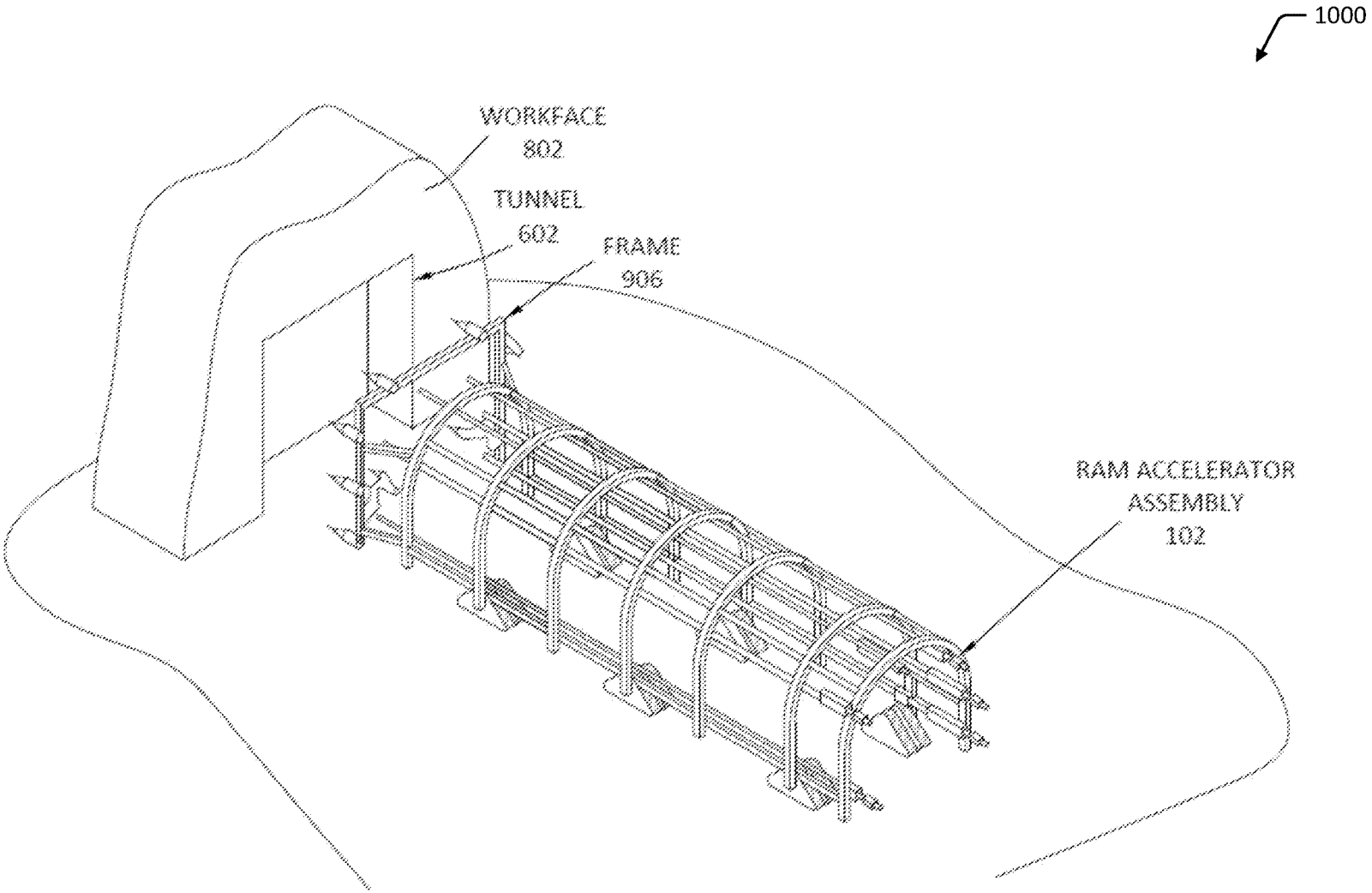
FIG. 10 is a diagram illustrating a perspective view of the tunneling unit of FIG. 9 positioned to interact with and form a tunnel within a workface, such as a rock face or other type of material or surface.

FIG. 10 is a diagram 1000 illustrating a perspective view of the tunneling unit 902 of FIG. 9 positioned to interact with and form a tunnel 602 within a workface 802, such as a rock face or other type of material or surface. As described previously, the tunneling unit 902 may include one or more water jets 904 at the leading (e.g., front) end thereof, and ram accelerator assemblies 102 at or near a trailing (e.g., rear) end thereof. The water jets 904 may be positioned on an outer portion of a structural frame 906 of the tunneling unit 902, which may have a generally rectangular shape, while the ram accelerator assemblies 102 are positioned on an inner portion of the structural frame 906 having a generally semicircular shape. The tunneling until 902 may be positioned on tracks 908 or a similar component to enable movement of the tunneling unit 902 into or out from a tunnel 602.

Figure 11:
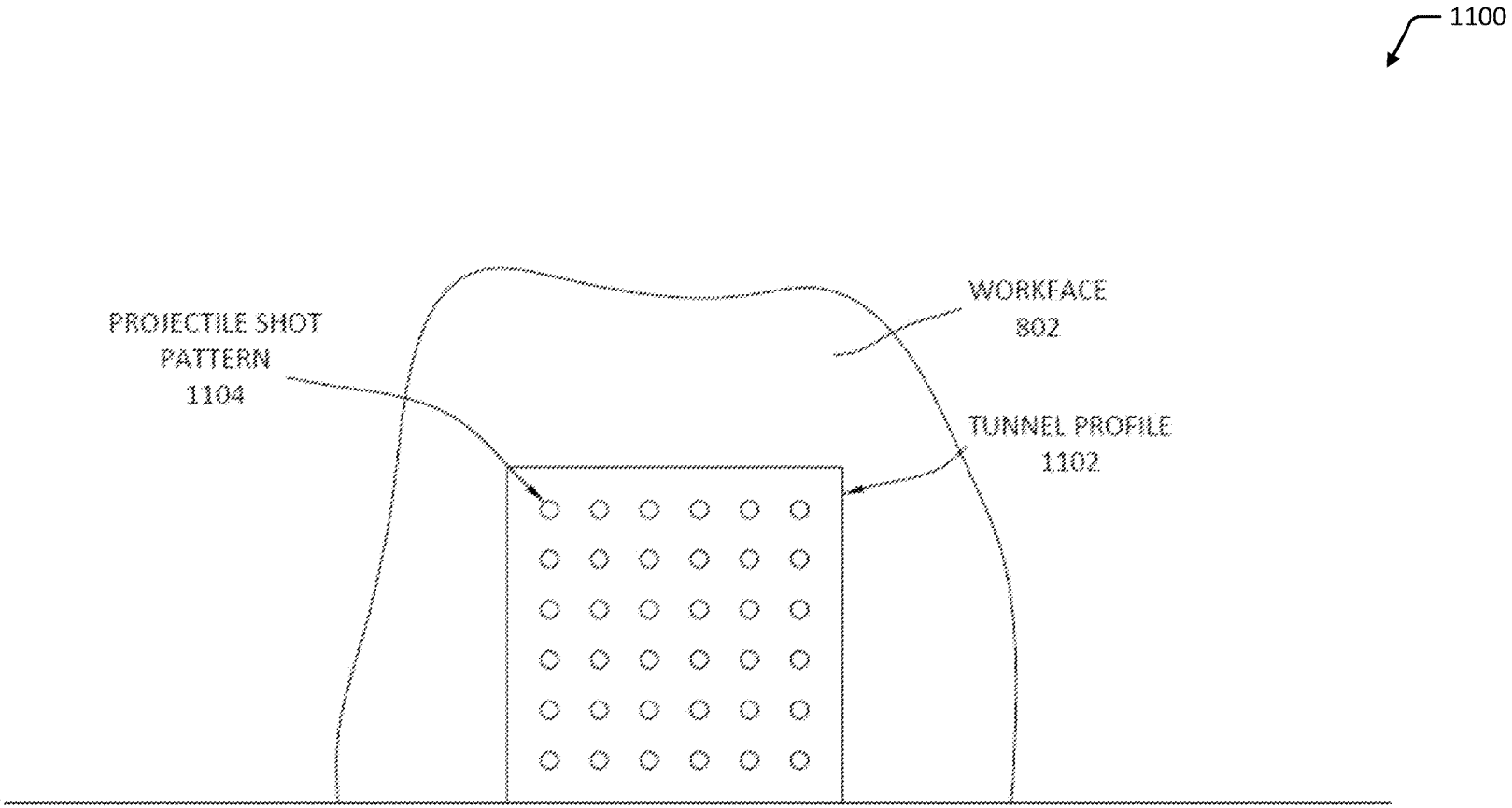
FIG. 11 depicts a diagram in which a tunnel profile for a tunnel may be formed using pre-conditioning devices, while a projectile shot pattern may be used to displace material to form a section of a tunnel based on the tunnel profile.

In some implementations, the water jets 904 may be used to pre-condition a portion of a rock face or other material having a non-circular profile, such as a square or rectangular cross-sectional shape. For example, FIG. 11 depicts a diagram 1100 in which a tunnel profile 1102 for a tunnel 602 may be formed using pre-conditioning devices, while a projectile shot pattern 1104 may be used to displace material to form a section of a tunnel 602 based on the tunnel profile 1102. After pre-conditioning a portion of the rock face using the water jets 904, one or more ram accelerator assemblies 102 may then be used to fire projectiles 202 into the workface 802 or other material at locations within the pre-conditioned profile formed by the water jets 904. Interactions between the projectiles 202 and the workface 802 or other material may break, pulverize, or otherwise degrade the material, forming a tunnel section having the shape of the pre-conditioned profile. Mucking operations may then be used to remove the degraded material from the tunnel 602 to enable advancing of the tunneling unit 902. Due to the generally open interior of the tunneling unit 902, mucking operations, as well as other operations, may be performed without requiring removal of the tunneling unit 902, such as by passing personnel or equipment beneath the structural frame of the tunneling unit 902.

While FIGS. 9-11 depict a tunneling unit 902 that includes water jets 904, in other implementations, other methods for pre-conditioning or cutting a rock face or other material may be used. For example, rock saw blades, rotating cutters, disc cutters, road headers, water jets with added abrasives, thermal spallation, thermal conditioning (e.g., heating and breaking rock), plasma jet cutters, pre-drilling, and so forth may be used in addition to or in place of water jets 904 to cut or pre-condition a desired profile. In some implementations, ram accelerator assemblies 102 or other projectile-firing devices may be used to cut or pre-condition a rock face or other material. For example, projectile impacts may be used to form holes around the perimeter of a desired profile in a rock face.

Use of water jets 904 or other mechanisms to pre-condition or pre-cut a rock face or other material in a desired cross-sectional shape may increase the efficiency of rock breaking operations. For example, by using water jets 904 to form a square or rectangular perimeter shape, or another desired shape for the cross-section of a portion of a tunnel 602, the breakage of rock using projectile impacts from the ram accelerator assemblies 102 may be controlled. Continuing the example, breakage caused by projectile impacts may be limited to a pre-cut or pre-conditioned region of rock, thereby controlling the shape of the material that is removed from a workface 802. In some implementations, the gain and near-bore rock damage may be controlled by use of the water jets 904 to create a gap, or a region of weakened rock or rock having a different density. The region of the rock affected by the water jets 904 may simulate a free face reflection zone so that a shock wave caused by a projectile impact changes from a compression wave to a tension wave, which pulls and breaks the pre-conditioned rock along the perimeter defined by the pre-conditioning of water jets 904. For example, creation of a cut or pre-conditioned region of rock may provide a boundary zone where, when metallic, ceramic, erodible, or explosive-tipped projectiles, or other types of projectiles, are fired, the projectiles impact rock within the pre-conditioned region, creating a compression wave that is affected by the cut or weakened region of rock as described above. In other implementations, shock waves may be created using other mechanisms in addition to or in place of projectile impacts, such as through use of dynamite or other explosives. Use of the implementations described herein may more efficiently pre-condition a rock face for breakage compared to conventional methods, and more efficiently break the rock face using projectile impacts, which may be timed and spaced in a manner that controls the shockwaves of the impacts and creates a region for broken rock or other material to fall.

Figure 12:
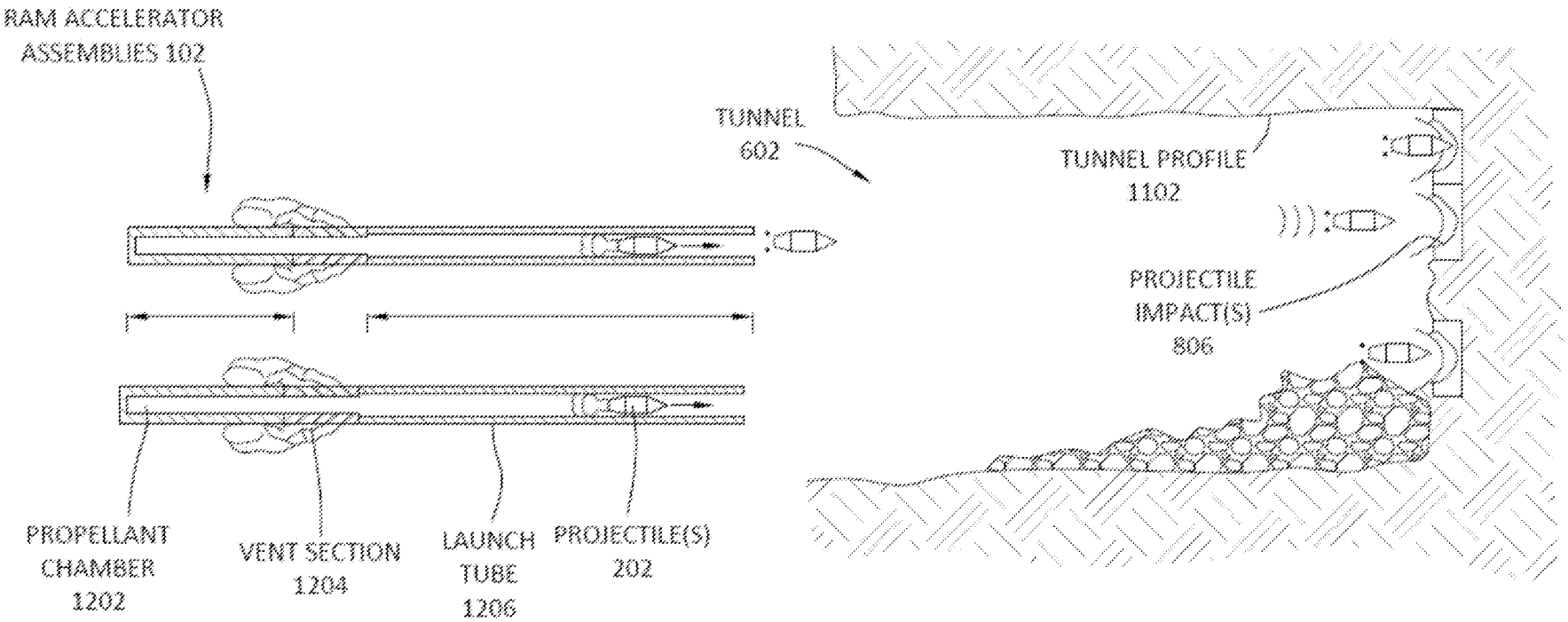
FIG. 12 is a diagram illustrating an implementation of interactions between projectiles accelerated using ram accelerator assemblies and a preconditioned portion of a tunnel.

For example, FIG. 12 is a diagram 1200 illustrating an implementation of interactions between projectiles 202 accelerated using ram accelerator assemblies 102 and a preconditioned portion of a tunnel 602. A ram accelerator assembly 102 may include a propellant chamber 1202 for providing propellant material to one or more other portions of the ram accelerator assembly 102 to impart a force to a projectile 202. In some implementations, the propellant chamber 1202 may include a gas gun or other source of motive force. A vent section 1204 may include one or more blast ports or other openings to enable gas created by pressurization, combustion, a chemical reaction, or other interactions with a propellant material to exit the ram accelerator assembly 102. Interactions between the propellant material and the projectile 202 may accelerate the projectile 202 through a launch tube 1206 of the ram accelerator assembly 102 into contact with rock or another material, causing a projectile impact 806 to break or weaken the material. In some implementations, interactions between the interior of the launch tube 1206 and exterior features of the projectile 202 may impart a ram effect to the projectile 202 to increase the speed thereof. For example, the interior of the launch tube 1206 may include baffles, rails, variations in the interior diameter of the launch tube 1206, or other features that interact with the body of the projectile 202 to increase the speed of the projectile.

In some implementations, multiple projectiles may impact different parts of a pre-conditioned region of a rock face or other material to break the material, as described above, forming debris that may be removed from the resulting tunnel section using mucking operations or other methods of transport or removal. For example, a tunnel profile 1102 of the tunnel section may be formed using water jets 904 or other pre-conditioning devices. The tunnel section may be extended by breaking the pre-conditioned region within the tunnel profile 1102 using projectile impacts. The resulting tunnel section may have a cross-sectional shape determined based on the pre-conditioning of the rock or other material using water jets 904 or other methods of cutting or pre-conditioning. In some implementations, a single ram accelerator assembly 102 may be used to accelerate multiple projectiles 202 into a rock face or other material, at the same location or at multiple different locations. For example, a single ram accelerator assembly 102 may be used in succession to provide projectiles 202 to various regions of a rock face. In other cases, multiple ram accelerator assemblies 102 may be used, sequentially or simultaneously, to impact the same or different regions of a rock face or other material with projectiles 202. For example, the projectile shot pattern 1104 shown in FIG. 11 may be applied to a rock face using multiple different ram accelerator assemblies 102 to accelerate projectiles 202 simultaneously or close-in-time.

Providing a rock face or other workface 802 with a pre-cut region, such as a region having a square shape, may cause plastic strain from a projectile impact to extend into the pre-cut portion of the rock face. For example, providing the bottom of a hole or the end of a tunnel 602 with a square-shaped pre-cut region prior to impacting a workface 802 with one or more projectiles 202 may facilitate changing the cross-sectional shape of subsequent portions of the hole or tunnel 602. Formation of a pre-conditioned or pre-cut region, using water jets 904, rock saws, impacts from projectiles 202, or other methods described above, may be performed as discrete processes, or a continuous process. For example, water jets 904 or other mechanisms for pre-conditioning a workface 802 may be used continuously or in rapid succession between impacts from projectiles 202. While implementations described herein include use of ram accelerator assemblies 102, other mechanisms for accelerating projectiles may be used. For example, supersonic or hypersonic mass drivers, electric rail guns, or other devices may be used to accelerate projectiles 202 toward a workface 802.

Implementations described herein may be used for formation of tunnels 602 that are horizontal, vertical, angled, or have other orientations. A tunnel 602 may also include a mine shaft, a vertical tunnel such as a borehole, or other types of holes or tunnels. Additionally, some implementations may include formation of tunnels 602 under water, or in other pressurized environments. Computing devices and sensors may be used to determine times and orientations for actuating water jets 904 or other pre-conditioning devices, and for actuating ram accelerator assemblies 102 or other methods for accelerating projectiles.

In some implementations, a rock face or other material may be broken first, such as by one or more projectile impacts 806, prior to forming a pre-conditioned region using water jets 904 or other devices, then impacting the rock again to break the rock in a desired shape. In some implementations, if portions of a pre-conditioned region of a rock face or other material is not fully removed by projectile impacts, such as corner regions of a square-shaped pre-conditioned area, a scaling bar, jack hammer, drill bit, cutter, or other mechanical implement may be used to remove remaining material from the pre-conditioned region. In some cases, a water jet 904 may be used to remove the remaining material, such as by cutting the material in a radial direction.

In other cases, additional projectile impacts may be used to remove material not removed by the initial projectile impacts 806. For example, a smaller projectile impact 806 (e.g., using a smaller projectile, less force, or a projectile having different characteristics) may be used to remove remaining material not fully removed by an initial projectile impact 806. In some implementations, water jets 904 may be articulated to project water in directions that are not parallel with the centerline of the tunnel face, such as to provide better control of the location of the edge of a pre-conditioned region during firing of the water jets.

While implementations described above with regard to FIGS. 9-12 depict a single unit that includes water jets 904, ram accelerator assemblies 102, and so forth, in other implementations, a system that includes a projectile accelerating device, pumps, power, robotics, pre-conditioning devices, and so forth may include multiple separate units that may be controlled and coordinated using one or more computing devices. For example, sensors and other instrumentation may be used to remotely control and coordinate operations of various devices, manually or autonomously, such as to meet certain sets of parameters for rates of production. In some cases, an acoustic barrier, air barrier, gas barrier, or other type of separation may be provided between one or more pieces of equipment, such as to control dust, noise, and so forth.

Figure 13:
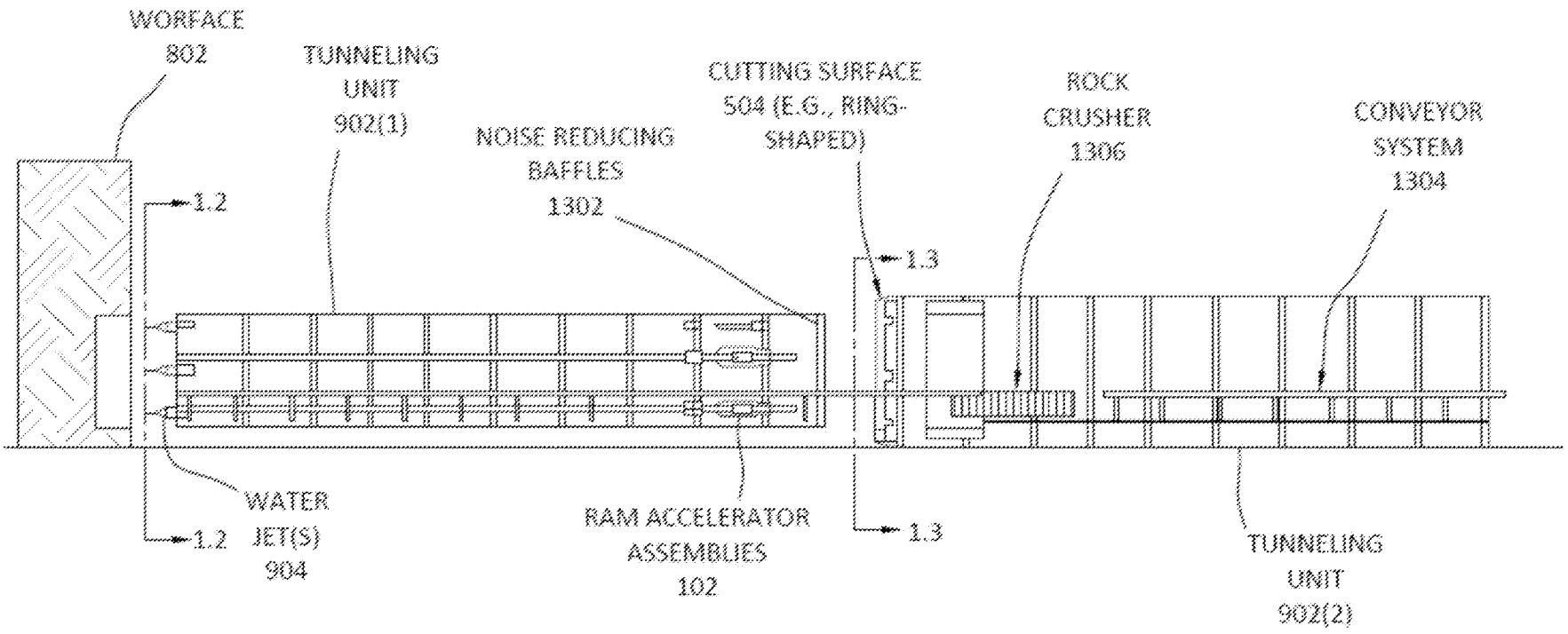
FIG. 13 is a diagram depicting an implementation of a system that includes multiple tunneling units.

In some implementations, multiple tunneling units 902 may be used in succession. For example, FIG. 13 is a diagram 1300 depicting an implementation of a system that includes multiple tunneling units 902. A first tunneling unit 902(1) may include water jets 904 and ram accelerator assemblies 102, as described with regard to FIGS. 9-12. A second tunneling unit 902(2) may be positioned behind the first tunneling unit 902(1) and may include a cutting surface 504 having a ring-shaped configuration. For example, the second tunneling unit 902(2) may include a tunnel boring machine (TBM) with a ring cutter.

In some implementations, the first tunneling unit 902(1) may be mounted to a generally cylindrical structural frame 906. The second tunneling unit 902(2) may be mounted to a generally cylindrical structural frame 906 having a larger diameter than that of the first tunneling unit 902(1). For example, FIG. 13 depicts the first tunneling unit 902(1) having water jets 904 at a front end, ram accelerator assemblies 102 at a back end, and noise-reducing baffles 1302 behind the ram accelerator assemblies 102. In some implementations, noise-reducing baffles 1302 may be installed in a terminal bulkhead of the first tunneling unit 902(1). Bulkheads and baffles may be used to acoustically isolate the first tunneling unit 902(1), reducing the effect of noise caused by rock breaking and firing of projectiles occurring ahead of the second tunneling unit 902(2) when it follows closely behind the first tunneling unit 902(1). For example, the second tunneling unit 902(2) may include a manned section having one or more human operators, and use of bulkheads, baffles, or both bulkheads and baffles may reduce the exposure of human operators to noise from rock breaking and firing of projectiles.

The first tunneling unit 902(1) is shown in front of and spaced apart from the second tunneling unit 902(2), which is shown positioned on a larger cylindrical frame 906. The first tunneling unit 902(1) and second tunneling unit 902(2) may be spaced apart by a selected separation distance, such as for controlling noise, debris, and so forth. While FIG. 13 depicts the cutting surface 504 of the second tunneling unit 902(2) having a ring-shaped configuration, in other implementations, the second tunneling unit 902(2) may include an articulating cutter, such as a long wall miner or road header, disc cutters along a multiple rotation axis machine, and so forth. Because the first tunneling unit 902(1) may be used to break the majority of rock to form a tunnel section, the second tunneling unit 902(2) may have a variety of shapes that differ from those of traditional TBMs.

In some implementations, a conveyor system 1304 may be incorporated within one or more of the tunneling units 902. For example, a conveyor belt may be used to transport broken rock, debris, or other materials out from a tunnel 602, and in some cases, to transport other materials into the tunnel 602. In some cases, a rock crusher 1306 or similar device may be positioned on or in front of the conveyor system 1304 to crush, break, or otherwise degrade or process the broken rock or other debris transported using the conveyor system 1304. For example, FIG. 13 shows a rock crusher 1306 positioned in association with a portion of a material handling conveyor system 1304 within the structural frame 906 of the second tunneling unit 902(2). In other implementations, a rock crusher 1304 may be positioned within the structural frame 906 of the first tunneling unit 902(1) in addition to or in place of a rock crusher 1304 associated with the second tunneling unit 902(2). For example, a projectile impact from the first tunneling unit 902(1) may create sizeable pieces of debris that may be crushed or otherwise processed by a rock crusher 1304 before providing the debris to pass through or into the second tunneling unit 902(2). In some cases, both tunneling units 902 may constitute two independently controlled units that share a similar mucking methodology. For example, the tunneling units 902 may be independently controlled, while a single conveyor belt or other material conveying system may be used to move material associated with both tunneling units 902.

During use, the first tunneling unit 902(1) may be used to break a portion of a rock face, as described previously, forming a section of a tunnel 602. The second tunneling unit 902(2), being associated with a ring-shaped frame 906 having a larger diameter than that of the first tunneling unit 902(1), may be used to ream the outer edges of the tunnel section created by the first tunneling unit 902(1). As the tunneling units 902 are advanced into a newly-formed tunnel section, the second tunneling unit 902(2) may ream or expand the outer edges of the tunnel section previously created by the first tunneling unit 902(1).

Figure 14:
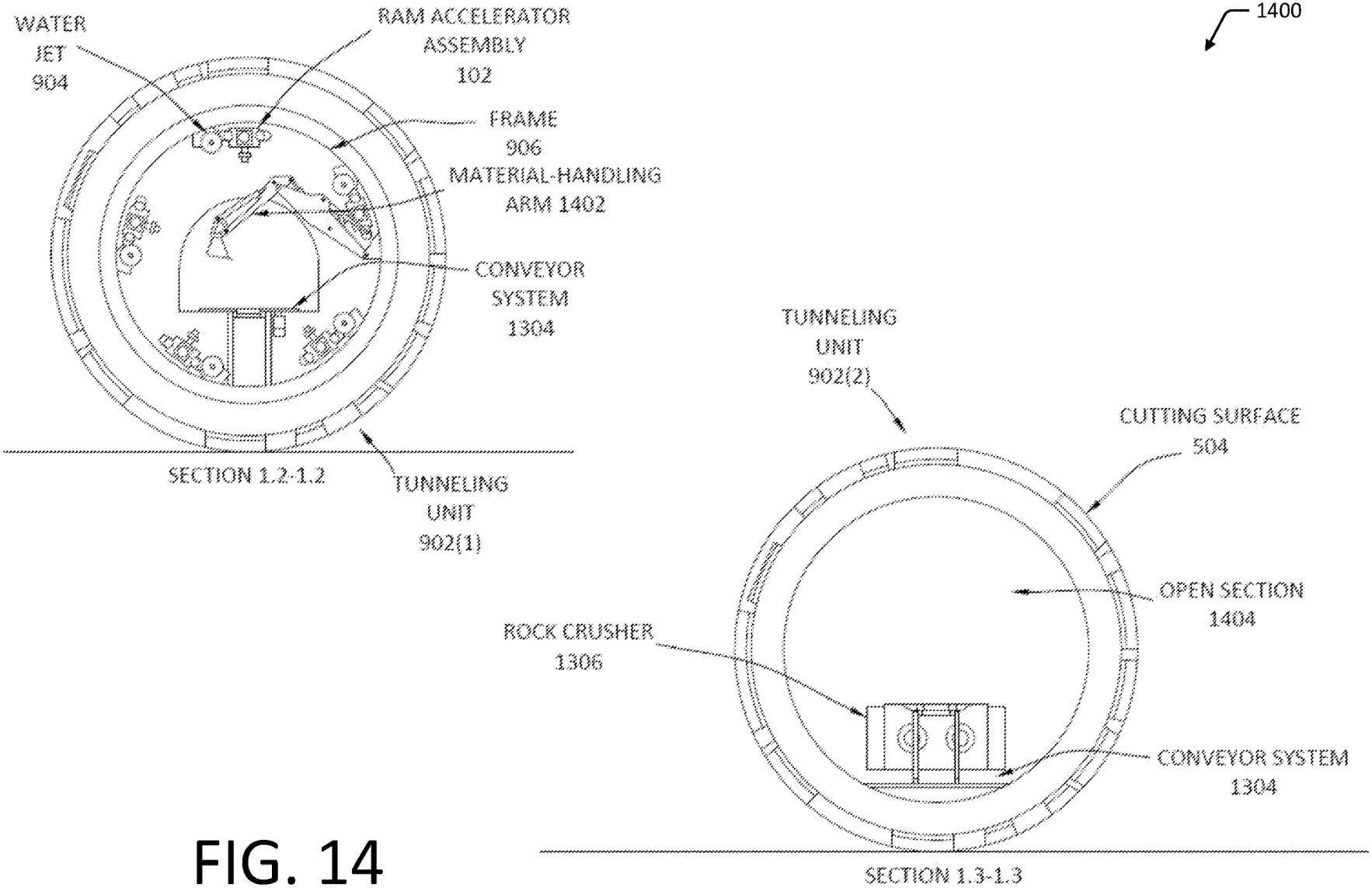
FIG. 14 is a series of diagrams showing front views of an implementation of the first tunneling unit and second tunneling unit of FIG. 13.

FIG. 14 is a series of diagrams 1400 showing front views of an implementation of the first tunneling unit 902(1) and second tunneling unit 902(2) of FIG. 13. The first tunneling unit 902(1) may include water jets 904 or other types of pre-conditioning devices, and ram accelerator assemblies 102 or other types of projectile acceleration devices, mounted to a structural frame 906. In the implementation shown in FIG. 14, the structural frame 906 has a generally cylindrical shape, however in other implementations, other shapes may be used. The water jets 904 may be used to pre-cut or pre-condition a rock face, such as by weakening a perimeter of a region of the rock face. Then, the ram accelerator assemblies 102 may be used to accelerate one or more projectiles 202 into the rock face within the perimeter. Impact between the projectiles 202 and the rock face may facilitate breakage of the rock within the perimeter, while the presence of the pre-cut or pre-conditioned perimeter may cause the shock waves caused by projectile impacts to pull and remove rock from the region of the rock face within the perimeter, as described previously. While FIG. 14 depicts the ram accelerator assemblies 102 positioned along an interior surface of a frame 906, in other implementations, the ram accelerator assemblies 102 may be positioned along an outer surface of the frame 906, or along a front edge of the frame 906. Similarly, the water jets 904 may be positioned at other locations on the frame 906.

The first tunneling unit 902(1) may be a self-contained unit that may be used independently of the second tunneling unit 902(2), and may be independently controllable from the second tunneling unit 902(2). When the first tunneling unit 902(1) is positioned close to a rock face, the depicted water jets 904 may be actuated to pre-condition the rock face in a full, 360-degree profile. The ram accelerator assemblies 102, also mounted around the circumference of the frame, may be used to break the preconditioned rock face by firing multiple projectiles into the rock face in succession. Projectile impacts may break the region of the rock face defined by the preconditioning of the water jets, causing sections of rock to fall within the newly-formed tunnel section. A conveyor system 1304 within the first tunneling unit 902(1) may be used to transport the material to mucking equipment located farther from the rock face.

In some implementations, the first tunneling unit 902(1) may include a material-handling arm 1402, such as an excavator arm and bucket, which may be mounted to the leading edge of the frame of the first tunneling unit 902(1). For example, the material-handling arm 1402 may be remotely, automatically, or manually controllable to facilitate movement of broken rock or other materials away from or toward the rock face. While FIG. 14 depicts an excavator arm and bucket as an example device for conveying debris and other materials, other types of devices for moving material may also be used.

In some implementations, each water jet 904, ram accelerator assembly 102, the depicted material-handling arm 1402, and the conveyor system 1304 shown in the first tunneling unit 902(1) may be independently and automatically operated, such as remotely using controls outside of the tunnel 602 or in a manned portion of the second tunneling unit 902(2) located behind the first tunneling unit 902(1).

Additionally, FIG. 14 depicts a front view of the second tunneling unit 902(2), which in some implementations may include a ring-shaped cutting surface 504 positioned along a generally cylindrical frame. In some implementations, the diameter of the ring cutter may be larger than that of the frame of the first tunneling unit 902(1). For example, the cutting surface 504 of the second tunneling unit 902(2) may further ream, weaken, degrade, smooth, or widen a section of tunnel after a rock face is initially broken using the first tunneling unit 902(1). In other implementations, the second tunneling unit 902(2) may include an articulating cutter, such as a long wall miner or road header, disc cutters along a multiple rotation axis machine, and so forth. Because the first tunneling unit 902(1) is used to break the majority of rock to form a tunnel section, the cutting surface 504 of the second tunneling unit 902(2) may have a variety of shapes that differ from those of traditional TBMs.

Broken rock or other materials broken by the first tunneling unit 902(1), or by the second tunneling unit 902(2), may pass through a central open section 1404 of the second tunneling unit 902(2). For example, the conveyor system 1304 may pass through the open section 1404 and may transport broken rock or other material away from or toward the rock face. As described previously, in some implementations, a rock crusher 1306 or other device for breaking, crushing, or otherwise processing the broken rock or other debris may be associated with the conveyor system 1304.

In some cases, the ring-shaped cutting surface 504 of the second tunneling unit 902(2) may act as a reamer that may clean and smooth the diameter of a tunnel section formed by using the first tunneling unit 902(1) to break and remove rock. Through the center of the ring section, the continuous conveyor system 1304 may be used to transport rock, debris, or other material from either tunneling unit 902 to a rock crusher 1306 located behind the cutting surface 504 of the second tunneling unit 902(2). The rock crusher 1306 may process larger rock removed from the rock face by one or both tunneling units 902. In some implementations, material processed by the rock crusher 1306 may then be fed to an additional conveyor system 1304 located behind the rock crusher 1306 and transported toward a mucking system.

In other implementations, one or more ram accelerator assemblies 102 or water jets 904 may be incorporated within the frame of the second tunneling unit 902(2). For example, ram accelerator assemblies 102 may be used to fire projectiles through a hole or lattice pattern within the ring shape of the second tunneling unit 902(2).

In some implementations, a tunneling unit 902 may be used in combination with a pressurized exhaust system, such as a system that includes one or more pressurized screw augers. For example, a pressurized screw auger or another similar device may be used to transfer broken rock created by projectile impacts through a pressure-acoustic barrier within which the tunneling unit 902 may operate. This may enable the tunneling unit to be operated at different pressures, as well as control the passage of exhaust gasses separately, transmit or direct the flow of exhaust gasses, and so forth.

Figure 15:
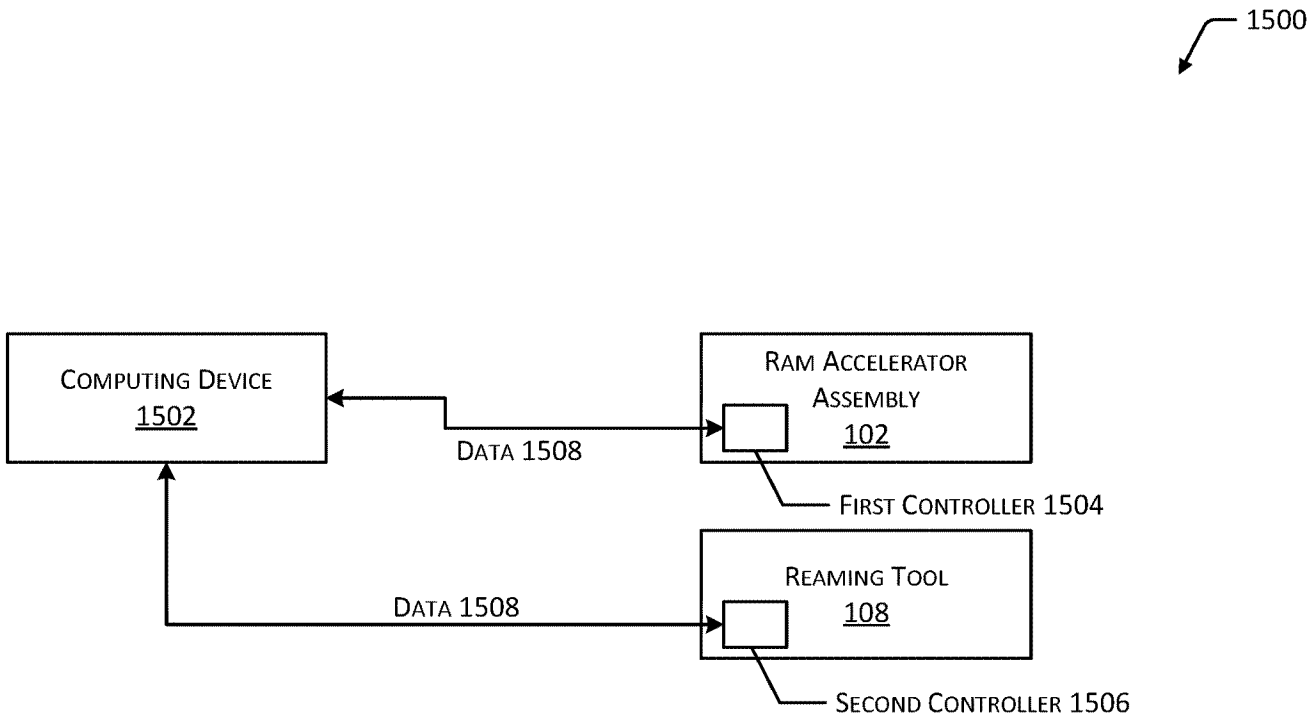
FIG. 15 is a diagram depicting a computing device, a first controller associated with a ram accelerator assembly, and a second controller associated with a reaming tool.

FIG. 15 is a diagram 1500 depicting a computing device 1502, a first controller 1504 associated with a ram accelerator assembly 102, and a second controller 1506 associated with a reaming tool 108. The computing device 1502 may send data 1508 to and receive data 1508 from the first controller 1504 and the second controller 1506, such as to cause the ram accelerator assembly 102 to accelerate a projectile 202 into contact with geologic material, cause the reaming tool 108 to position a cutting surface into contact with geologic material, or to cause movement of a boring assembly that includes the reaming tool 108. In some implementations, the computing device 1502 may execute computer-executable instructions to determine data 1508 indicative of a rate of removal of debris, a rate of penetration of the reaming tool 108, a count of projectiles 202 or a rate of acceleration of projectiles 202 from the ram accelerator assembly 102, and may provide data 1508 to the ram accelerator assembly 102 indicative of the determined count of projectiles 202 or rate for acceleration of projectiles 202. In some implementations, the computing device 1502 may execute computer-executable instructions to determine data 1508 indicative of characteristics of geologic material, and in response to correspondence between this data 1508 and threshold data indicative of threshold characteristics, may provide data 1508 to the ram accelerator assembly 102 to cause acceleration of a projectile 202 toward a region of the geologic material.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

What is claimed is:

1. A system comprising:

a ram accelerator assembly comprising:

a first launch tube having an end oriented toward a first region of geologic material;

a projectile within the first launch tube;

a propellant material within the first launch tube, wherein ignition of the propellant material applies a first force to the projectile to accelerate the projectile out from the first launch tube and into contact with the first region of the geologic material; and a first source of motive force, wherein the ram accelerator assembly is movable toward and away from the first region of the geologic material;

a boring assembly comprising:

a cutting tool having at least one cutting surface, wherein one or more of the cutting tool or the at least one cutting surface is movable to contact one or more of the first region or a second region of the geologic material adjacent to the first region, wherein the at least one cutting surface includes a first orifice having a first diameter and a second orifice having a second diameter greater than the first diameter, and wherein the first orifice is associated with the first launch tube and the second orifice is associated with a second launch tube; and a second source of motive force, wherein the boring assembly is movable toward and away from the first region of the geologic material and is movable independently from the ram accelerator assembly; and a collection assembly comprising:

a first member positioned below the first launch tube and the cutting tool, wherein the first member is movable to contact debris that is created by one or more of the contact between the projectile and the first region or the contact between the at least one cutting surface and the one or more of the first region or the second region, and wherein movement of the first member moves at least a portion of the debris onto the first member; and a second member associated with the first member, wherein the second member applies a second force to the at least a portion of the debris on the first member to move the at least a portion of the debris away from the one or more of the first region or the second region of the geologic material.

2. The system of claim 1, wherein the collection assembly is engaged to the boring assembly and contacts the debris by movement of the boring assembly toward the one or more of the first region or the second region.

3. The system of claim 1, wherein the second member of the collection assembly comprises one or more of: at least one arm, at least one pivotable portion of the first member, or a conveyor system to move the at least a portion of the debris away from the one or more of the first region or the second region.

4. The system of claim 3, further comprising a movable receptacle that receives the at least a portion of the debris moved by the one or more of the at least one arm, the at least one pivotable portion, or the conveyor system.

5. The system of claim 1, further comprising:

a first controller associated with the ram accelerator assembly;

a second controller associated with the boring assembly; and one or more computing devices in communication with the first controller and the second controller, wherein the one or more computing devices execute computer-executable instructions to:

cause the ram accelerator assembly to accelerate the projectile into contact with the first region of the geologic material;

cause the cutting tool to position the at least one cutting surface into contact with the one or more of the first region or the second region of the geologic material to form a first portion of a shaft; and move the boring assembly at least partially into the first portion of the shaft.

6. The system of claim 1, further comprising:

a first controller associated with the ram accelerator assembly;

a second controller associated with the boring assembly; and one or more computing devices in communication with the first controller and the second controller, wherein the one or more computing devices execute computer-executable instructions to:

determine first data indicative of a rate of removal of the debris away from the one or more of the first region or the second region;

determine a rate of penetration of the cutting tool that is associated with a rate of generation of debris that is less than or equal to the rate of removal;

determine one or more of a count of projectiles to accelerate toward the geologic material or a rate for acceleration of projectiles toward the geologic material that corresponds to the rate of penetration of the cutting tool; and provide second data to the first controller, wherein the second data is indicative of the one or more of the count of projectiles or the rate for acceleration of projectiles.

7. The system of claim 1, further comprising one or more tunnel stabilization mechanisms oriented to provide one or more of: a bolt, a nail, concrete, or mortar to a third region of the geologic material.

8. The system of claim 7, wherein the one or more of the first region or the second region of the geologic material comprises an end of a shaft and the third region of the geologic material comprises one or more of a floor, a ceiling, or a wall of the shaft.

9. The system of claim 1, wherein the projectile comprises an exterior feature, the first launch tube comprises one or more interior features, and an interaction between the exterior feature and the one or more interior features during movement of the projectile within the first launch tube accelerates the projectile using a ram effect.

10. The system of claim 1, wherein the projectile passes through the first orifice, and the second launch tube is associated with a second projectile that is larger than the projectile, and wherein the second launch tube is positioned to accelerate the second projectile through the second orifice.

11. A method comprising:

accelerating a first projectile through a first launch tube and through a first orifice of a cutting surface into contact with a first region of geologic material, wherein the first orifice of the cutting surface has a first diameter and the first projectile at least partially weakens the geologic material at the first region;

accelerating a second projectile through a second launch tube and through a second orifice of the cutting surface into contact with one or more of the first region or a second region of the geologic material, wherein the second orifice of the cutting surface has a second diameter that differs from the first diameter;

contacting the geologic material with the cutting surface to displace at least a portion of the geologic material and form a first section of a shaft; and moving the cutting surface into the first section of the shaft.

12. The method of claim 11, further comprising:

positioning a movable frame relative to the geologic material, wherein at least one preconditioning device is engaged to the movable frame, and the movable frame is separate from and separately movable from a cutting tool that includes the cutting surface;

using the at least one preconditioning device to accelerate a first material from a position of the movable frame into contact with the geologic material to form a region of displaced material that corresponds to a perimeter of the first section of a shaft, wherein the first region of geologic material is within the perimeter; and after contacting the geologic material with the cutting surface, moving the movable frame toward the first section of the shaft.

13. The method of claim 11, further comprising:

positioning a movable frame relative to the geologic material, the movable frame comprises an open section, and one or more of the first projectile, the second projectile, or the cutting surface contacts the geologic material to form debris;

moving a member positioned below the cutting surface into contact with the debris to displace at least a portion of the debris onto the member; and applying a force to the at least a portion of the debris to move the at least a portion of the debris away from the first section of the shaft, wherein the debris is conveyed away from the first section of the shaft through the open section of the movable frame.

14. The method of claim 13, wherein applying the force to the at least a portion of the debris includes actuating a conveyor system associated with the member, wherein at least a portion of the conveyor system is positioned within the open section of the movable frame.

15. The method of claim 11, further comprising:

accelerating a third projectile into contact with a third region of the geologic material, wherein the third projectile at least partially weakens the geologic material at the third region;

contacting the third region of the geologic material with the cutting surface to displace at least a portion of the geologic material at the third region and form a second section of the shaft; and moving the cutting surface into the second section of the shaft.

16. A system comprising:

a cutting tool having a cutting surface;

a first launch tube associated with a first projectile and first propellant material for accelerating the first projectile toward a first region of geologic material, wherein the first launch tube is positioned to pass the first projectile through at least one first orifice in the cutting surface having a first diameter to contact the first region of the geologic material, and the cutting surface is movable to contact the first region; and a second launch tube associated with a second projectile that is larger than the first projectile, wherein the second launch tube is positioned to accelerate the second projectile through at least one second orifice having a second diameter larger than the first diameter.

17. The system of claim 16, further comprising:

a controller associated with the first launch tube; and one or more computing devices in communication with the controller, wherein the one or more computing devices include computer-executable instructions to:

determine first data indicative of one or more first characteristics of the geologic material; and in response to correspondence between the first data and threshold data indicative of one or more second characteristics, provide second data to the controller to cause acceleration of the first projectile toward the first region.

18. The system of claim 16, wherein contact between the geologic material and one or more of the first projectile, the second projectile, or the cutting surface generates debris, the system further comprising:

a controller associated with one or more of the first launch tube or the second launch tube; and one or more computing devices in communication with the controller, wherein the one or more computing devices include computer-executable instructions to:

determine first data indicative of a rate of removal of the debris away from the first region;

determine a rate of penetration of the cutting tool that is associated with a rate of generation of debris that is less than or equal to the rate of removal; and provide second data to the controller, wherein the second data is indicative of one or more of: a count of projectiles to accelerate toward the geologic material or a rate for acceleration of projectiles toward the geologic material.

19. The system of claim 16, wherein the at least one first orifice is positioned on a first side of the cutting surface and the at least one second orifice is positioned on a second side of the cutting surface.

20. The system of claim 16, further comprising:

a movable vehicle, wherein the cutting tool is mounted on the movable vehicle, and wherein the movable vehicle is movable toward and away from the first region of the geologic material.

* * * * *